US010480837B2

(12) United States Patent
Minami et al.

(10) Patent No.: US 10,480,837 B2
(45) Date of Patent: Nov. 19, 2019

(54) REFRIGERATION APPARATUS

(71) Applicant: DAIKIN INDUSTRIES, LTD., Osaka-shi, Osaka (JP)

(72) Inventors: Junya Minami, Sakai (JP); Masahiro Oka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 54 days.

(21) Appl. No.: 15/314,070

(22) PCT Filed: May 26, 2015

(86) PCT No.: PCT/JP2015/065041
§ 371 (c)(1),
(2) Date: Nov. 26, 2016

(87) PCT Pub. No.: WO2015/182585
PCT Pub. Date: Dec. 3, 2015

(65) Prior Publication Data

US 2017/0198955 A1 Jul. 13, 2017

(30) Foreign Application Priority Data

May 28, 2014 (JP) ..... 2014-110071

(51) Int. Cl.
*F25B 47/02* (2006.01)
*F25B 13/00* (2006.01)
(Continued)

(52) U.S. Cl.
CPC ..... *F25B 47/025* (2013.01); *F25B 13/00* (2013.01); *F25B 47/02* (2013.01); *F25B 47/022* (2013.01);
(Continued)

(58) Field of Classification Search
CPC ..... F25B 13/00; F25B 2313/0233; F25B 2600/2515; F25B 2313/0253;
(Continued)

(56) References Cited

U.S. PATENT DOCUMENTS 4,766,734 A * 8/1988 Dudley ..... F24D 17/02 62/160
5,095,711 A * 3/1992 Marris ..... F25B 47/025 62/156
(Continued)

FOREIGN PATENT DOCUMENTS

EP 1 793 179 A1 6/2005
JP 3-55474 A 3/1991
(Continued)

OTHER PUBLICATIONS

European Search Report of corresponding EP Application No. 15 80 0460.6 dated May 4, 2017.
(Continued)

*Primary Examiner* — Cassey D Bauer
*Assistant Examiner* — Miguel A Diaz
(74) *Attorney, Agent, or Firm* — Global IP Counselors, LLP

(57) ABSTRACT

A refrigeration apparatus includes a compressor, a heat-source-side heat exchanger operable as a refrigerant evaporator or radiator, and a usage-side heat exchanger operable as a refrigerant evaporator or radiator. The heat-source-side heat exchanger is disposed inside a heat source unit having an exhaust port and an outdoor fan in an upper part, and an intake port in a side part. The heat-source-side heat exchanger includes first and second heat-source-side heat exchangers. Adjustable first and second heat-source-side flow rate adjusting valves are connected to liquid sides of the first and second heat-source-side heat exchangers, respec-
(Continued)

tively. In a defrost operation in order to defrost the first and second heat-source-side heat exchangers, the opening degrees of the first and second heat-source-side flow rate adjusting valves are controlled so as to achieve a defrost flow rate ratio at which more refrigerant flows to the second heat-source-side heat exchanger than during an air-cooling operation.

4 Claims, 9 Drawing Sheets

(51) Int. Cl.
*F25B 49/02* (2006.01)
*F25B 47/00* (2006.01)

(52) U.S. Cl.
CPC ..... *F25B 49/02* (2013.01); *F25B 2313/005* (2013.01); *F25B 2313/0231* (2013.01); *F25B 2313/0233* (2013.01); *F25B 2313/0253* (2013.01); *F25B 2313/0294* (2013.01); *F25B 2347/02* (2013.01); *F25B 2600/2513* (2013.01); *F25B 2600/2515* (2013.01)

(58) Field of Classification Search
CPC ..... F25B 2600/2513; F25B 2313/0231; F25B 47/025; F25B 47/022; F25B 2313/0294; F25B 2313/005; F25B 6/02; F25B 2313/0251; F25B 2347/021; F25B 41/043; F25B 2313/02522; F28F 9/026; F28F 9/0263; F28F 9/0275; F28F 9/0282
USPC ..... 62/278, 151, 80
See application file for complete search history.

(56) References Cited

U.S. PATENT DOCUMENTS

2010/0170270 A1* 7/2010 Jang ..... F25B 13/00 62/81
2010/0251761 A1* 10/2010 Yoshimi ..... F25B 1/10 62/524
2010/0300141 A1* 12/2010 Fujimoto ..... F25B 1/10 62/498
2011/0030409 A1* 2/2011 Fujimoto ..... F25B 1/10 62/324.6
2012/0118533 A1* 5/2012 Jang ..... F25B 49/02 165/96
2012/0266616 A1* 10/2012 Lee ..... F25B 13/00 62/80
2012/0312040 A1* 12/2012 Choi ..... B60H 1/00392 62/156
2013/0104580 A1* 5/2013 Choi ..... F25B 1/10 62/115
2013/0145785 A1* 6/2013 Nobuhiro ..... F25B 49/02 62/160
2013/0192809 A1* 8/2013 Kim ..... F25B 39/00 165/175
2014/0102131 A1* 4/2014 Okamoto ..... F25B 1/10 62/510
2014/0245766 A1* 9/2014 Wakamoto ..... F25B 13/00 62/151
2016/0033179 A1* 2/2016 Kim ..... F25B 13/00 62/324.6
2016/0116202 A1* 4/2016 Takenaka ..... F25B 13/00 62/140
2016/0178249 A1* 6/2016 Kwon ..... F25B 13/00 62/160
2016/0223236 A1* 8/2016 Kimura ..... F24F 3/065
2016/0238285 A1* 8/2016 Kawano ..... F25B 13/00
2016/0245596 A1* 8/2016 Higashiiue ..... F25B 39/00
2016/0273795 A1* 9/2016 Takenaka ..... F24F 13/30
2016/0356534 A1* 12/2016 Hatada ..... F25B 13/00
2016/0370045 A1* 12/2016 Takenaka ..... F25B 47/02
2017/0108249 A1* 4/2017 Morishita ..... F25B 13/00
2017/0153050 A1* 6/2017 Nakagawa ..... F25B 47/022
2017/0198944 A1* 7/2017 Susaki ..... F24F 11/89
2017/0219264 A1* 8/2017 Song ..... F25B 13/00
2017/0336115 A1* 11/2017 Kanaya ..... F24F 11/89
2018/0058736 A1* 3/2018 Jin ..... F25B 39/00

FOREIGN PATENT DOCUMENTS

JP 5-71832 A 3/1993
JP 5-332637 A 12/1993
JP 05332637 A * 12/1993
JP 9-14802 A 1/1997
JP 2002-89980 A 3/2002
JP 2002089980 A * 3/2002
JP WO 2006003860 A1 * 1/2006 ..... F24F 1/50
JP 2009-228975 A 10/2009
JP 2012-207803 A 10/2012
WO 2006003860 A1 1/2006
WO WO-2006003860 A1 * 1/2006 ..... F24F 1/50

OTHER PUBLICATIONS

Notification of Reasons for Refusal of corresponding Japanese Application No. 2014-110071 dated Oct. 6, 2016.
International Preliminary Report of corresponding PCT Application No. PCT/JP2015/065041 dated May 26, 2015.
International Search Report of corresponding PCT Application No. PCT/JP2015/065041 dated Aug. 18, 2015.

* cited by examiner

REFRIGERATION APPARATUS

CROSS-REFERENCE TO RELATED APPLICATIONS

This U.S. National stage application claims priority under 35 U.S.C. § 119(a) to Japanese Patent Application No. 2014-110071, filed in Japan on May 28, 2014, the entire contents of which are hereby incorporated herein by reference.

TECHNICAL FIELD

The present invention relates to a refrigeration apparatus, and particularly relates to a refrigeration apparatus in which a vertically divided heat-source-side heat exchanger is disposed inside an upward-blowing-type heat source unit.

BACKGROUND ART

In the past, there have been air conditioning apparatuses that are a type of refrigeration apparatus configured to include a compressor, an outdoor heat exchanger (a heat-source-side heat exchanger), and an indoor heat exchanger (a usage-side heat exchanger), as is presented in Japanese Laid-open Patent Publication Nos. H5-332637 and 2002-89980. In these refrigeration apparatuses, the heat-source-side heat exchanger is vertically divided, and expansion valves (heat-source-side flow rate adjusting valves), the opening degrees of which are adjustable, are connected to the liquid sides of these heat-source-side heat exchangers.

SUMMARY OF THE INVENTION

With the conventional refrigeration apparatuses described above, there are cases, such as that of Japanese Laid-open Patent Publication No 1-15-332637, in which the vertically divided heat-source-side heat exchangers are disposed inside a heat source unit ("upward-blowing-type" heat source unit) that has an exhaust port and an outdoor fan in an upper part, that has an intake port in a side part, and that is configured so as to suction air into the interior from the intake port and to exhaust the air to the exterior from the exhaust port, the heat-source-side heat exchangers being disposed so as to face the intake port. In these cases, an air flow rate distribution in which air flows readily to the upper-side heat-source-side heat exchanger (a first heat-source-side heat exchanger) is obtained. Therefore, the size of flow dividers of the heat-source-side heat exchangers, the opening size of the heat-source-side flow rate adjusting valves, and the like are designed so that the refrigerant flows readily to the first heat-source-side heat exchanger but does not flow readily to the lower-side heat-source-side heat exchanger (a second heat-source-side heat exchanger). Specifically, the refrigerant flows more readily to the first heat-source-side heat exchanger and less readily to the second heat-source-side heat exchanger, in comparison with the ratio of the heat transfer area between the first heat-source-side heat exchanger and the second heat-source-side heat exchanger.

With such design considerations, the desired performance is readily achieved because the air flow rate distribution achieved by employing an upward-blowing-type heat source unit (the air flow rate distribution with which air flows readily to the upper-side first heat-source-side heat exchanger) is taken into account in an air-cooling operation and/or an air-heating operation. However, in a defrost operation, which is performed when frost has formed on the first and second heat-source-side heat exchangers due to the air-heating operation, the fact that the design hinders the flow of the refrigerant to the second heat-source-side heat exchanger causes the liquid refrigerant to readily accumulate in the second heat-source-side heat exchanger and the speed at which frost melts in the second heat-source-side heat exchanger to decrease, and defrost time therefore tends to be longer. During defrost operation of vertically divided heat-source-side heat exchangers in Patent Literature 2, a control is employed which reduces the opening degree of the heat-source-side flow rate adjusting valve in whichever has the higher refrigerant temperature between the first and second heat-source-side heat exchangers, and which increases the opening degree of the heat-source-side flow rate adjusting valve in the heat exchanger that has the lower refrigerant temperature. However, with this control, the liquid refrigerant readily accumulate in the heat-source-side heat exchanger in which the opening degree of the heat-source-side flow rate adjusting valve has been reduced, and there is a risk that the liquid refrigerant will flow back from the second heat-source-side heat exchanger to the compressor when the air-heating operation is resumed after the defrost operation.

An object of the present invention is to provide a refrigeration apparatus in which vertically divided heat-source-side heat exchangers are disposed in an upward-blowing-type heat source unit, wherein frost on upper and lower heat-source-side heat exchangers can be melted simultaneously and defrost time can be shortened during a defrost operation.

A refrigeration apparatus according to a first aspect includes a compressor, a heat-source-side heat exchanger that can be caused to function as an evaporator or a radiator of a refrigerant, and a usage-side heat exchanger that can be caused to function as an evaporator or a radiator of the refrigerant. In this aspect, the heat-source-side heat exchanger is disposed inside a heat source unit that has an exhaust port and an outdoor fan in an upper part, that has an intake port in a side part, and that is configured so as to suction air into the interior from the intake port and to exhaust the air out to the exterior from the exhaust port, the heat-source-side heat exchanger being disposed so as to face the intake port, and the heat-source-side heat exchanger being divided so as to include a first heat-source-side heat exchanger and a second heat-source-side heat exchanger on a lower side of the first heat-source-side heat exchanger. A first heat-source-side flow rate adjusting valve, the opening degree of which is adjustable, is connected to the liquid side of the first heat-source-side heat exchanges; and a second heat-source-side flow rate adjusting valve, the opening degree of which is adjustable, is connected to the liquid side of the second heat-source-side heat exchanger. A defrost operation is performed for defrosting the first and second heat-source-side heat exchangers by stopping the outdoor fan and causing the first and second heat-source-side heat exchangers to function as radiators of refrigerant when frost forms on the first and second heat-source-side heat exchangers which function as evaporators of refrigerant. The opening degrees of the first and second heat-source-side flow rate adjusting valves are controlled in the defrost operation so as to achieve a defrost flow rate ratio, which is a flow rate ratio at which more refrigerant flows to the second heat-source-side heat exchanger than during an air-cooling operation in which the first and second heat-source-side heat exchangers are caused to function as radiators of the refrigerant and the usage-side heat exchangers are caused to function as evaporators of the refrigerant. These operations and controls are performed by a control part of the refrigerant apparatus.

According to the aspect described above, the flow rate of the refrigerant passing through the second heat-source-side heat exchanger is can be made to be greater during the defrost operation than during the air-cooling operation. Therefore, in this aspect the liquid refrigerant does not readily accumulate in the second heat-source-side heat exchanger, and the speed at which frost is melted in the second heat-source-side heat exchanger can be increased.

According to the aspect described above, the frost on the upper and lower heat-source-side heat exchangers can thereby be melted simultaneously during the defrost operation, and defrost time can be shortened.

A refrigeration apparatus according to a second aspect is the refrigeration apparatus according to the first aspect, wherein the defrost flow rate ratio is achieved by setting the second heat-source-side flow rate adjusting valve to frilly open and setting the first heat-source-side flow rate adjusting valve to an opening degree that is less than the opening degree during the air-cooling operation.

According to the aspect described above, in the defrost operation, setting the second heat-source-side flow rate adjusting valve to be fully open yields a state in which the refrigerant flows as readily as possible to the second heat-source-side heat exchanges; and setting the first heat-source-side flow rate adjusting valve to an opening degree less than the opening degree during the air-cooling operation allows the flow rate of the refrigerant flowing through the second heat-source-side heat exchanger to be reliably increased.

The defrost flow rate ratio can thereby be reliably achieved in the defrost operation in this aspect.

A refrigeration apparatus according to a third aspect is the refrigeration apparatus according to the first or second aspect, wherein the opening degrees of the first and second heat-source-side flow rate adjusting valves are set in the defrost operation to opening degrees that yield the defrost flow rate ratio when the defrost operation is started, and until the defrost operation ends, the opening degrees are kept at the opening degrees that are set when the defrost operation is started.

When the opening degrees of the first and second heat-source-side flow rate adjusting valves are changed during the defrost operation, the refrigerant sometimes accumulates readily in a heat-source-side heat exchanger corresponding to a heat-source-side flow rate adjusting valve of which the opening degree has become relatively small. Should such an accumulation of the refrigerant occur, there is a risk that the liquid refrigerant will readily flow back to the compressor from the heat-source-side heat exchanger having this refrigerant accumulation when the defrost operation is ended and the air-heating operation, or another operation in which the heat-source-side heat exchanger is caused to function as an evaporator of the refrigerant, is resumed.

In view of this, in tins aspect, the defrost operation is performed without changing the opening degrees of the first and second heat-source-side flow rate adjusting valves from the start of the defrost operation until the end.

Control during the defrost operation is thereby simplified in this aspect, and liquid backflow after the defrost operation has ended can also be suppressed

DESCRIPTION OF EMBODIMENTS

Embodiments of the refrigeration apparatus pertaining to the present invention are described below with reference to the accompanying drawings. The specific configuration of die refrigeration apparatus according to the present invention is not limited to the following embodiment and modification, and can be changed within a range that does not deviate from the scope of the invention.

(1) Configuration of the Refrigeration Apparatus (Simultaneous-Cooling/Heating-Operation-Type Air Conditioning Apparatus)

Figure 1:
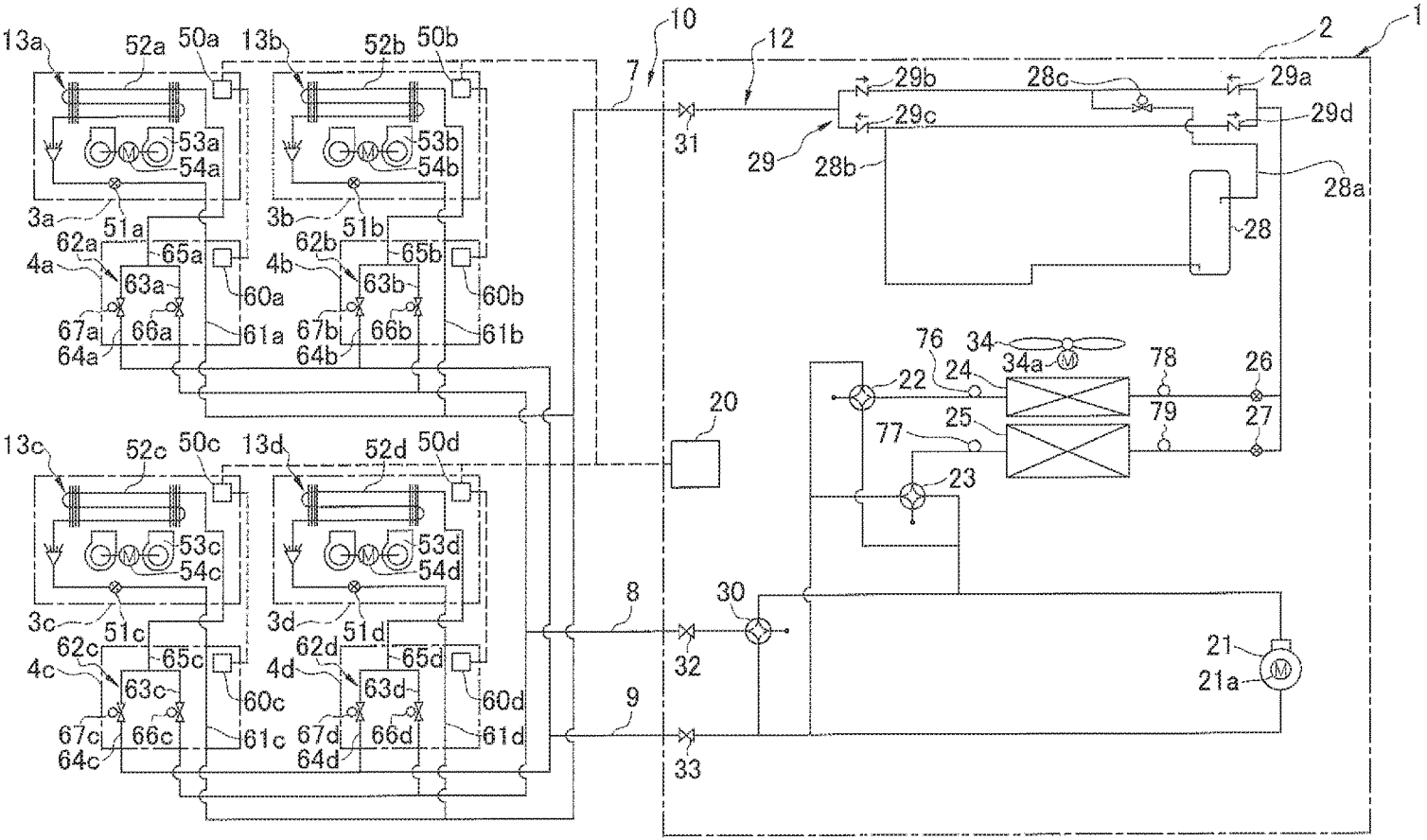
FIG. 1 is a schematic configuration diagram illustrating a simultaneous-cooling/heating-operation-type air conditioning apparatus as an embodiment of the refrigeration apparatus according to the present invention.
Figure 2:
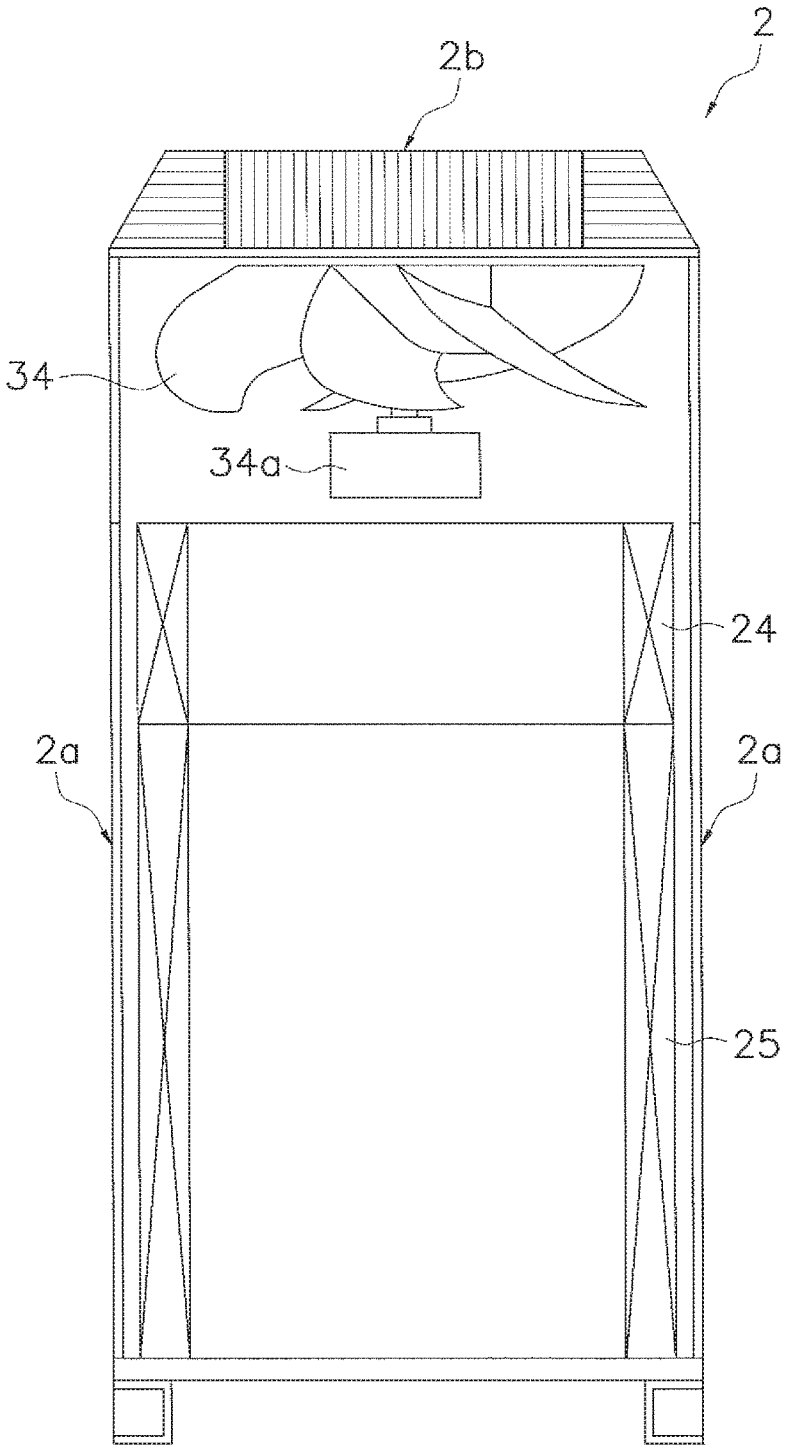
FIG. 2 is a view illustrating a general internal structure of a heat source unit, constituting the simultaneous-cooling/heating-operation-type air conditioning apparatus.
Figure 3:
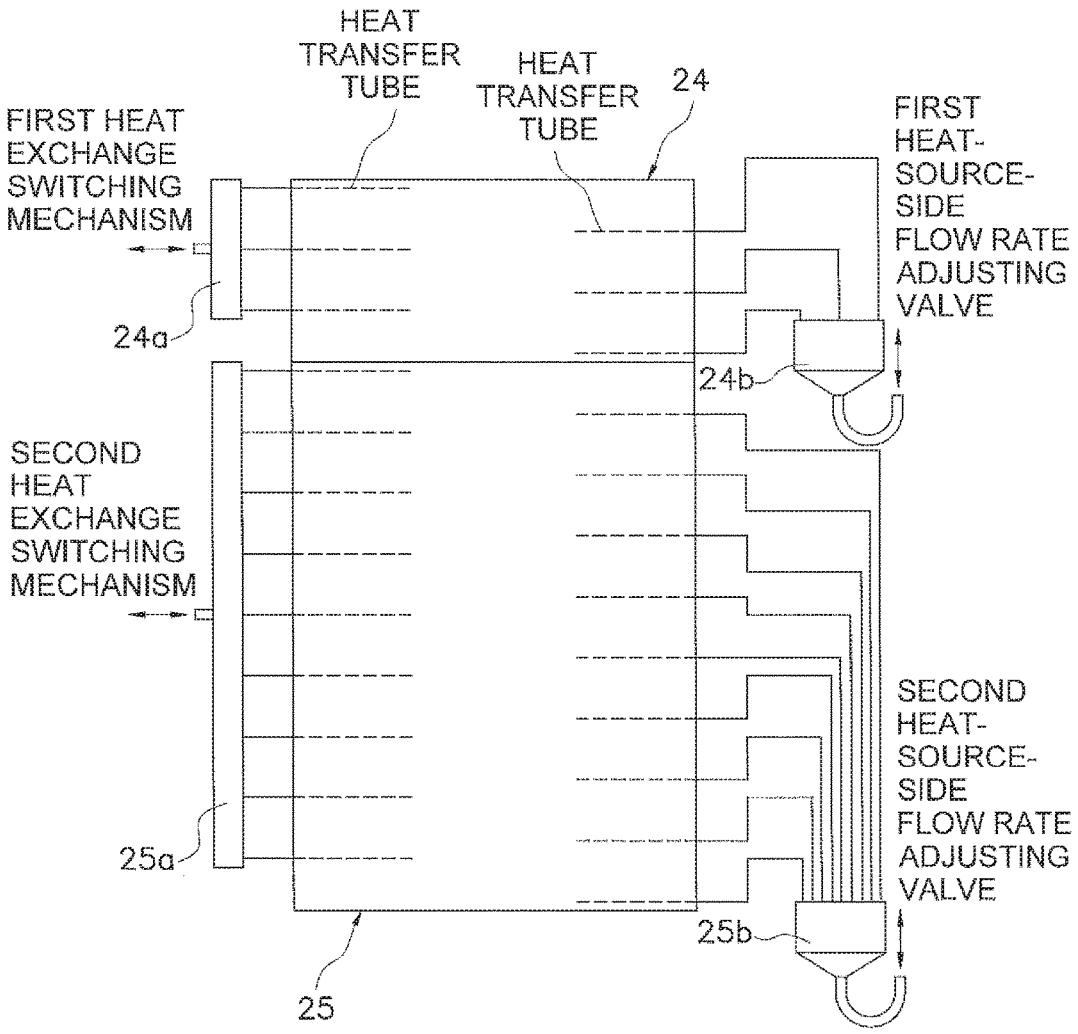
FIG. 3 is a view schematically illustrating a structure of heat-source-side heat exchangers.

FIG. 1 is a schematic configuration diagram illustrating a simultaneous-cooling/heating-operation-type air conditioning apparatus 1 as an embodiment of the refrigeration apparatus according to the present invention. FIG. 2 is a view illustrating a general internal structure of a heat source unit 2 constituting the simultaneous-cooling/heating-operation-type air conditioning apparatus 1. FIG. 3 is a view schematically illustrating a structure of heat-source-side heat exchangers 24, 25. The simultaneous-cooling/heating-operation-type air conditioning apparatus 1 is used for indoor air cooling/heating in a building or the like by performing a vapor-compression-type refrigerating cycle.

The simultaneous-cooling/heating-operation-type air conditioning apparatus 1 has primarily a single heat-source unit 2, a plurality of (four in the present embodiment) usage units 3*a*, 3*b*, 3*c*, 3*d*, connecting units 4*a*, 4*b*, 4*c*, 4*d* connected to the usage units 3*a*, 3*b*, 3*c*, 3*d*, and refrigerant communicating pipes 7, 8, 9 for connecting the heat-source unit 2 and the usage units 3*a*, 3*b*, 3*c*, 3*d* via the connecting units 4*a*, 4*b*, 4*c*, 4*d*. Specifically, a vapor-compression-type refrigerant circuit 10 of the simultaneous-cooling/heating-operation-type air conditioning apparatus 1 is configured by the connecting of the heat-source unit 2, the usage units 3*a*, 3*b*, 3*c*, 3*d*, the connecting units 4*a*, 4*b*, 4*c*, 4*d*, and the refrigerant communicating pipes 7, 8, 9. The simultaneous-cooling/heating-operation-type air conditioning apparatus 1 is also configured so that the usage units 3*a*, 3*b*, 3*c*, 3*d* can individually perform an air-cooling operation or an air-heating operation, and a refrigerant is sent from the usage unit for performing the air-heating operation to the usage unit for performing the air-cooling operation, whereby heat can be recovered between the usage units (i.e., a simultaneous cooling/heating operation can be performed in which the air-cooling operation and the air-heating operation are performed simultaneously). The simultaneous-cooling/heating-operation-type air conditioning apparatus 1 is also configured so that the heat load of the heat-source unit 2 is balanced in accordance with the overall heat load of the plurality of usage units 3*a*, 3*b*, 3*c*, 3*d* taking into account the heat recovery (the simultaneous cooling/heating operation) described above.

<Usage Units>

The usage units 3*a*, 3*b*, 3*c*, 3*d* are installed by being built into or suspended from an indoor ceiling of a building or the like, by hanging on an indoor wall surface, or by other means. The usage units 3*a*, 3*b*, 3*c*, 3*d* are connected to the heat-source unit 2 via the refrigerant communicating pipes 7, 8, 9 and the connecting units 4*a*, 4*b*, 4*c*, 4*d*, and constitute a portion of the refrigerant circuit 10.

The configuration of the usage units 3*a*, 3*b*, 3*c*, 3*d* will next be described. The usage unit 3*a* and the usage units 3*b*, 3*c*, 3*d* have the same configuration. Therefore, only the configuration of the usage unit 3*a* will be described. To refer to the configuration of the usage units 3*b*, 3*c*, 3*d*, the subscripts "b" "c" and "d" are added instead of "a" to the reference signs for indicating the components of the usage unit 3*a*, and the components of the usage units 3*b*, 3*c*, 3*d* will not be described.

The usage unit 3*a* primarily constitutes a portion of the refrigerant circuit 10 and has a usage-side refrigerant circuit 13*a* (usage-side refrigerant circuits 13*b*, 13*c*, 13*d* in the usage units 3*b*, 3*c*, 3*d*, respectively). The usage-side refrigerant circuit 13*a* has primarily a usage-side flow rate adjusting valve 51*a* and a usage-side heat exchanger 52*a*.

The usage-side flow rate adjusting valve 51*a* is an electric expansion valve, the opening degree of which is adjustable, connected to a liquid side of the usage-side heat exchanger 52*a* in order to perform adjustment and the like of the flow rate of the refrigerant flowing through the usage-side heat exchanger 52*a*.

The usage-side heat exchanger 52*a* is a device for exchanging heat between the refrigerant and an indoor air, and is a fin-and-tube type heat exchanger configured from a plurality of heat transfer tubes and fins, for example. Here, the usage unit 3*a* has an indoor fan 53*a* for drawing the indoor air into the unit and supplying the air indoors as a supply air after heat is exchanged, and is capable of causing heat to be exchanged between the indoor air and the refrigerant flowing through the usage-side heat exchanger 52*a*. The indoor fan 53*a* is driven by an indoor fan motor 54*a*.

The usage unit 3*a* has a usage-side control unit 50*a* for controlling the operation of the components 51*a*, 54*a* constituting the usage unit 3*a*. The usage-side controller 50*a* has a microcomputer and/or memory for controlling the usage unit 3*a*, and is configured so as to be capable of exchanging control signals and the like with a remote control (not shown), and exchanging control signals and the like with the heat source unit 2.

<Heat Source Unit>

The heat-source unit 2 is installed on the roof or elsewhere in a building or the like, is connected to the usage units 3*a*, 3*b*, 3*c*, 3*d* via the refrigerant communicating pipes 7, 8, 9, and constitutes the refrigerant circuit 10 with the usage units 3*a*, 3*b*, 3*c*, 3*d*.

The configuration of the heat-source unit 2 will next be described. The heat-source unit 2 primarily constitutes a portion of the refrigerant circuit 10 and has a heat-source-side refrigerant circuit 12. The heat-source-side refrigerant circuit 12 has primarily a compressor 21, a plurality of (two in the present embodiment) heat exchange switching mechanisms 22, 23, a plurality of (two in the present embodiment) heat-source-side heat exchangers 24, 25, a plurality of (two in the present embodiment) heat-source-side flow rate adjusting valves 26, 27, a receiver 28, a bridge circuit 29, a high/low pressure switching mechanism 30, a liquid-side shutoff valve 31, a high/low-pressure-gas-side shutoff valve 32, and a low-pressure-gas-side shutoff valve 33.

The compressor 21 is a device for compressing the refrigerant, and is a scroll-type or other type of positive-displacement compressor capable of varying an operating capacity by inverter control of a compressor motor 21*a*, for example.

The first heat exchange switching mechanism 22 is a four-way switching valve, for example, and is a device capable of switching a flow path of the refrigerant in the heat-source-side refrigerant circuit 12 so that a discharge side of the compressor 21 and a gas side of the first heat-source-side heat 24 are connected (as indicated by solid lines in the first heat exchange switching mechanism 22 in FIG. 1) when the first heat-source-side heat exchanger 24 is caused to function as a radiator of the refrigerant (referred to below as a "radiating operation state"), and an intake side of the compressor 21 and the gas side of the first heat-source-side heat exchanger 24 are connected (as indicated by broken lines in the first heat exchange switching mechanism 22 in FIG. 1) when the first heat-source-side heat exchanger 24 is caused to function as an evaporator of the refrigerant (referred to below as an "evaporating operation state"). The second heat exchange switching mechanism 23 is a four-way switching valve, for example, and is a device capable of switching a flow path of the refrigerant in the heat-source-side refrigerant circuit 12 so that the discharge side of the compressor 21 and a gas side of a second heat-source-side heat exchanger 25 are connected (as indicated by solid lines in the second heat exchange switching mechanism 23 in FIG. 1) when the second heat-source-side heat exchanger 25 is caused to function as a radiator of the refrigerant (referred to below as a "radiating operation state"), and the intake side of the compressor 21 and the gas side of the second heat-source-side heat exchanger 25 are connected (as indicated by broken lines in the second heat exchange switching mechanism 23 in FIG. 1) when the second heat-source-side heat exchanger 25 is caused to function as an evaporator of the refrigerant (referred to below as an "evaporating operation state"). By changing the switching states of the first heat exchange switching mechanism 22 and the second heat exchange switching mechanism 23, the first heat-source-side heat exchanger 24 and the second heat-source-side heat exchanger 25 can each individually be switched between functioning as an evaporator or a radiator of the refrigerant.

The first heat-source-side heat exchanger 24 is a device for performing heat exchange between the refrigerant and an outdoor air, and is, e.g., a fin-and-tube type heat exchanger configured from a plurality of heat transfer tubes and fins. The gas side of the first heat-source-side neat exchanger 24 is connected to the first heat exchange switching mechanism 22, and the liquid side of the first heat-source-side heat exchanger 24 is connected to the first heat-source-side flow rate adjusting valve 26. Specifically, a first header 24*a* for merging and branching the refrigerant from and into the plurality of heat transfer tubes constituting the first heat-source-side heat exchanger 24 is provided to the gas side of the first heat-source-side heat exchanger 24, and the first header 24*a* is connected to the first heat exchange switching mechanism 22. A first flow divider 24*b* for merging and branching the refrigerant from and into the plurality of heat transfer tubes constituting the first heat-source-side heat exchanger 24 is provided to the liquid side of the first heat-source-side heat exchanger 24, and the first flow divider 24*b* is connected to the first heat-source-side flow rate adjusting valve 26. The second heat-source-side heat exchanger 25 is a device for performing heat exchange between the refrigerant and the outdoor air, and is, e.g., a fin-and-tube type heat exchanger configured from a plurality of heat transfer tubes and fins. The gas side of the second heat-source-side heat exchanger 25 is connected to the second heat exchange switching mechanism 23, and the liquid side of the second heat-source-side heat exchanger 25 is connected to the second heat-source-side flow rate adjusting valve 27. Specifically, a second header 25*a* for merging and branching the refrigerant from and into the plurality of heat transfer tubes constituting the second heat-source-side heat exchanger 25 is provided to the gas side of the second heat-source-side heat exchanger 25, and the second header 25*a* is connected to the second heat exchange switching mechanism 23. A second flow divider 25*b* for merging and branching the refrigerant from and into the plurality of heat transfer tubes constituting the second heat-source-side heat exchanger 25 is provided to the liquid side of the second heat-source-side heat exchanger 25, and the second flow divider 25*b* is connected to the second heat-source-side flow rate adjusting valve 27.

The heat source unit 2 in this embodiment is an "upward-blowing-type" heat source unit having an exhaust port 2*b* and an outdoor fan 34 in the upper part, having an intake port 2*a* in a side part, and configured so that the air is suctioned into the interior from the intake port 2*a* and the air is exhausted out to the exterior from the exhaust port 2*b*. Specifically, the outdoor fan 34 suctions the outdoor air into the unit, and exhausts the air out of the unit after heat has been exchanged between the outdoor air and the refrigerant flowing through the heat-source-side heat exchangers 24, 25. The outdoor fan 34 is designed so as to be driven by an outdoor fan motor 34*a*.

The heat-source-side heat exchangers 24, 25 are disposed inside this type of heat source unit 2 so as to face the intake port 2*a*. The first heat-source-side heat exchanger 24 and the second heat-source-side heat exchanger 25 are vertically divided, and the first heat-source-side heat exchanger 24 is disposed on the upper side of the second heat-source-side heat exchanger 25. Specifically, the first heat-source-side heat exchanger 24 and the second heat-source-side heat exchanger 25 are configured as an integrated heat-source-side heat exchanger, which is caused to function as the first heat-source-side heat exchanger 24 by connecting the heat transfer tubes constituting the upper part to the first header 24*a* and the first flow divider 24*b*, and is caused to function as the second heat-source-side heat exchanger 25 by connecting the heat transfer tubes constituting the lower part to the second header 25*a* and the second flow divider 25*b*. Because an upward-blowing-type heat source unit is employed as the heat source unit 2 as described above in this embodiment, the air flow rate distribution is achieved such that the am flows readily to the upper-side first heat-source-side heat exchanger 24. Therefore, the sizes of the headers 24*a*, 25*a* and/or the flow dividers 24*b*, 25*b* are designed so that refrigerant flows readily to the first heat-source-side heat exchanger 24 and the refrigerant does not flow readily to the lower-side second heat-source-side heat exchanger 25. A configuration in which the heat transfer area of the first heat-source-side heat exchanger 24 and the heat transfer area of the second heat-source-side heat exchanger 25 differ is employed in this embodiment. Specifically, the heat transfer area of the second heat-source-side heat exchanger 25 is made greater than that of the first heat-source-side heat exchanger 24; e.g., the second heat-source-side heat exchanger 25 has a heat transfer area approximately 1.5 to 5 times that of the first heat-source-side heat exchanger 24. Therefore, in this embodiment, the sizes of the headers 24*a*, 25*a* and the flow dividers 24*b*, 25*b* are designed while taking into account both the ratio of the heat transfer areas of the first and second heat-source-side heat exchangers 24, 25, and the air flow rate distribution whereby the air flows readily to the upper-side first heat-source-side heat exchanger 24. Specifically, the sizes of the header 24*a* and/or the flow divider 24*b* on the first heat-source-side heat exchanger 24 side are large in comparison to the heat transfer area ratio, while the sizes of the header 25*a* and/or the flow divider 25*b* on the second heat-source-side heat exchanger 25 side are small in comparison to the heat transfer area ratio, ensuring that the refrigerant flows readily to the first heat-source-side heat exchanger 24 and the refrigerant does not flow readily to the second heat-source-side heat exchanger 25, proportionately with respect to the heat transfer area ratio between the first heat-source-side heat exchanger 24 and the second heat-source-side heat exchanger 25.

The first heat-source-side flow rate adjusting valve 26 is an electric expansion valve, the opening degree of which is adjustable, connected to the liquid side of the first heat-source-side heat exchanger 24 in order to perform adjustment and the like of the flow rate of the refrigerant flowing through the first heat-source-side heat exchanger 24. The second heat-source-side flow rate adjusting valve 27 is an electric expansion valve, the opening degree of which is adjustable, connected to the liquid side of the second heat-source-side heat exchanger 25 in order to perform adjustment and the like of the flow rate of the refrigerant flowing through the second heat-source-side heat exchanger 25. Because an upward-blowing-type heat source unit is employed as the heat source unit 2 as described above in this embodiment, the air flow rate distribution is achieved such that the air flows readily to the upper-side first heat-source-side heat exchanger 24. Therefore, the opening size (or rated Cv value) of the heat-source-side flow rate adjusting valves 26, 27 is designed so that refrigerant flows readily to the first heat-source-side heat exchanger 24 and refrigerant does not flow readily to the lower-side second heat-source-side heat exchanger 25. The configuration in which the heat transfer area of the first heat-source-side heat exchanger 24 and the heat transfer area of the second heat-source-side heat exchanger 25 differ is employed in this embodiment, as described above. Specifically, the heat transfer area of the second heat-source-side heat exchanger 25 is made greater than that of the first heat-source-side heat exchanger 24; e.g., the second heat-source-side heat exchanger 25 has a neat transfer area approximately 1.5 to 5 times that of the first heat-source-side heat exchanger 24. Therefore, in this embodiment, the opening size (or rated Cv value) of the heat-source-side flow rate adjusting valves 26, 27 is designed while taking into account both the ratio of the heat transfer areas of the first and second heat-source-side heat exchangers 24, 25, and the air flow rate distribution whereby air flows readily to the upper-side first heat-source-side heat exchanger 24. Specifically, the opening size (or rated Cv value) of the first heat-source-side flow rate adjusting valve 26 on the first heat-source-side heat exchanger 24 side is large in comparison to the heat transfer area ratio, while the size of the second heat-source-side flow rate adjusting valve 27 on the second heat-source-side heat exchanger 25 side is small in comparison to the heat transfer area ratio, ensuring that refrigerant flows readily to the first heat-source-side heat exchanger 24 and the refrigerant does not flow readily to the second heat-source-side heat exchanger 25, in comparison with the heat transfer area ratio between the first heat-source-side heat exchanger 24 and the second heat-source-side heat exchanger 25.

The receiver 28 is a container for temporarily storing the refrigerant flowing between the heat-source-side heat exchangers 24, 25 and the usage-side refrigerant circuits 13*a*, 13*b*, 13*c*, 13*d* A receiver inlet pipe 28*a* is provided to an upper part of the receiver 28, and a receiver outlet pipe 28*b* is provided to a lower part of the receiver 28. A receiver inlet opening/closing valve 28*c*, the opening and closing of which can be controlled, is provided to the receiver inlet pipe 28*a*. The receiver inlet pipe 28*a* and the receiver outlet pipe 28*b* of the receiver are connected between the liquid-side shutoff valve 31 and the heat-source-side heat exchangers 24, 25 via the bridge circuit 29.

The bridge circuit 29 is a circuit having a function for causing the refrigerant to flow into the receiver 28 through the receiver inlet pipe 28*a* and causing the refrigerant to flow out from the receiver 28 through the receiver outlet pipe 28*b* when the refrigerant flows toward the liquid-side shutoff valve 31 from the heat-source-side heat exchangers 24, 25, as well as when the refrigerant flows toward the heat-source-side heat exchangers 24, 25 from the liquid-side shutoff valve 31. The bridge circuit 29 has four check valves 29*a*, 29*b*, 29*c*, 29*d*. The inlet check valve 29*a* is a check valve for allowing the refrigerant to circulate only from the heat-source-side heat exchangers 24, 25 to the receiver inlet pipe 28*a*. The inlet check valve 29*b* is a check valve for allowing the refrigerant to circulate only from the liquid-side shutoff valve 31 to the receiver inlet pipe 28*a*. Specifically, the inlet check valves 29*a*, 29*b* have a function for causing the refrigerant to circulate from the heat-source-side heat exchangers 24, 25 or the liquid-side shutoff valve 31 to the receiver inlet pipe 28*a*. The outlet check valve 29*c* is a check valve for allowing the refrigerant to circulate only from the receiver outlet pipe 28*b* to the liquid-side shutoff valve 31. The outlet check valve 29*d* is a check valve for allowing the refrigerant to circulate only from the receiver outlet pipe 28*b* to the heat-source-side heat exchangers 24, 25. Specifically, the outlet check valves 29*c*, 29*d* have a function for causing the refrigerant to circulate from the receiver outlet pipe 28*b* to the heat-source-side heat exchangers 24, 25 or the liquid-side shutoff valve 31.

The high/low pressure switching mechanism 30 is a four-way switching valve, for example, and is a device capable of switching the flow path of the refrigerant in the heat-source-side refrigerant circuit 12 so that the high/low-pressure-gas-side shutoff valve 32 and the discharge side of the compressor 21 are connected (as indicated by broken lines in the high/low pressure switching mechanism 30 in FIG. 1) when the high-pressure gas refrigerant discharged from the compressor 21 is sent to the usage-side refrigerant circuits 13*a*, 13*b*, 13*c*, 13*d* (referred to below as a "radiation-load operation state"), and the high/low-pressure-gas-side shutoff valve 32 and the intake side of the compressor 21 are connected (as indicated by solid lines in the high/low pressure switching mechanism 30 in FIG. 1) when the high-pressure gas refrigerant discharged from the compressor 21 is not sent to the usage-side refrigerant circuits 13*a*, 13*b*, 13*c*, 13*d* (referred to below as an "evaporation-load operation state").

The liquid-side shutoff valve 31, the high/low-pressure-gas-side shutoff valve 32, and the low-pressure-gas-side shutoff valve 33 are valves provided to a port for connection with an external device/duct (specifically, the refrigerant communicating pipes 7, 8, 9). The liquid-side shutoff valve 31 is connected to the receiver inlet pipe 28*a* or the receiver outlet pipe 28*b* via the bridge circuit 29. The high/low-pressure-gas-side shutoff valve 32 is connected to the high/low pressure switching mechanism 30. The low-pressure-gas-side shutoff valve 33 is connected to the intake side of the compressor 21.

In addition, various sensors are provided to die heat source unit 2. Specifically, the heat source unit 2 is provided with a first gas-side temperature sensor 76 for detecting the temperature of the refrigerant in the gas side of the first heat-source-side heat exchanger 24, a second gas-side temperature sensor 77 for detecting the temperature of the refrigerant in the gas side of the second heat-source-side heat exchanger 25, a first liquid-side temperature sensor 78 for detecting the temperature of the refrigerant in the liquid side of the first heat-source-side heat exchanger 24, and a second liquid-side temperature sensor 79 for detecting the temperature of the refrigerant in the liquid side of the second heat-source-side heat exchanger 25. The heat-source unit 2 has the heat-source-side control part 20 for controlling the operation of the components 21*a*, 22, 23, 26, 27, 28*c*, 30, 34*a* constituting the heat-source unit 2. The heat-source-side control unit 20 has a microcomputer and memory provided for controlling the heat source unit 2, and is able to exchange control signals and the like with usage-side control units 50*a*, 50*b*, 50*c*, 50*d* of the usage units 3*a*, 3*b*, 3*c*, 3*d*.

<Connecting Units>

The connecting units 4*a*, 4*b*, 4*c*, 4*d* are provided together with the usage units 3*a*, 3*b*, 3*c*, 3*d* inside a building or the like. The connecting units 4*a*, 4*b*, 4*c*, 4*d* are interposed between usage units 3*a*, 3*b*, 3*c*, 3*d* and the heat-source unit 2 together with the refrigerant communicating pipes 7, 8, 9, and constitute a portion of the refrigerant circuit 10.

The configuration of the connecting units 4*a*, 4*b*, 4*c*, 4*d* will next be described. The connecting unit 4*a* and the connecting units 4*b*, 4*c*, 4*d* have the same configuration. Therefore, only the configuration of the connecting unit 4*a* will be described. To refer to the configuration of the connecting units 4*b*, 4*c*, 4*d*, the subscripts "*b*," "*c*," and "d" are added instead of "a" to the reference signs for indicating the components of the connecting unit 4*a*, and the components of the connecting units 4*b*, 4*c*, 4*d* will not be described.

The connecting unit 4*a* primarily constitutes a portion of the refrigerant circuit 10 and has a connection-side refrigerant circuit 14*a* (connection-side refrigerant circuit 14*b*, 14*c*, 14*d* in the connecting units 4*b*, 4*c*, 4*d*, respectively). The connection-side refrigerant circuit 14*a* has primarily a liquid connecting pipe 61*a* and a gas connecting pipe 62*a*.

The liquid connecting pipe 61*a* connects the liquid refrigerant communicating pipe 7 and the usage-side flow rate adjusting valve 51*a* of the usage-side refrigerant circuit 13*a*.

The gas connecting pipe 62*a* has a high-pressure gas connecting pipe 63*a* connected to the high/low-pressure gas refrigerant communicating pipe 8, a low-pressure gas connecting pipe 64*a* connected to the low-pressure gas refrigerant communicating pipe 9, and a merging gas connecting pipe 65*a* for merging the high-pressure gas connecting pipe 63*a* and the low-pressure gas connecting pipe 64*a*. The merging gas connecting pipe 65*a* is connected to the gas side of the usage-side heat exchanger 52*a* of the usage-side refrigerant circuit 13*a*. A high-pressure gas opening/closing valve 66*a*, the opening and closing of which can be controlled, is provided to the high-pressure gas connecting pipe 63*a*, and a low-pressure gas opening/closing valve 67*a*, the opening and closing of which can be controlled, is provided to the low-pressure gas connecting pipe 64*a*.

During the air-cooling operation by the usage unit 3*a*, the connecting unit 4*a* can function so that the low-pressure gas opening/closing valve 6*a* is placed in an open state, the refrigerant flowing into the liquid connecting pipe 61*a* through the liquid refrigerant communicating pipe 7 is sent to the usage-side heat exchanger 52*a* through the usage-side flow rate adjusting valve 51*a* of the usage-side refrigerant circuit 13*a*, and the refrigerant evaporated by heat exchange with the indoor air in the usage-side heat exchanger 52*a* is returned to the low-pressure gas refrigerant communicating pipe 9 through the merging gas connecting pipe 65*a* and the low-pressure gas connecting pipe 64*a*. During the air-heating operation by the usage unit 3*a*, the connecting unit 4*a* can function so that the low-pressure gas opening/closing valve 67*a* is closed and the high-pressure gas opening/closing valve 66*a* is placed in an open state, the refrigerant flowing into the high-pressure gas connecting pipe 63*a* and the merging gas connecting pipe 65*a* through the high/low-pressure gas refrigerant communicating pipe 8 is sent to the usage-side heat exchanger 52*a* of the usage-side refrigerant circuit 13*a*, and the refrigerant radiated by heat exchange with the indoor air in the usage-side heat exchanger 52*a* is returned to the liquid refrigerant communicating pipe 7 through the usage-side flow rate adjusting valve 51*a* and the liquid connecting pipe 61*a*. This function is performed not only by the connecting unit 4*a*, but also by the connecting units 4*b*, 4*c*, 4*d* in the same manner; and the usage-side heat exchangers 52*a*, 52*b*, 52*c*, 52*d* can therefore each individually be switched between functioning as evaporators or radiators of the refrigerant by the connecting units 4*a*, 4*b*, 4*c*, 4*d*.

The connecting unit 4*a* has a connection-side control part 60*a* for controlling the operation of the components 66*a*, 67*a* constituting the connecting unit 4*a*. The connection-side control part 60*a* has a microcomputer and/or memory provided to control the connecting unit 4*a*, and is configured so as to be capable of exchanging control signals and the like with the usage-side control unit 50*a* of the usage unit 3*a*.

The usage-side refrigerant circuits 13*a*, 13*b*, 13*c*, 13*d*, the heat-source-side refrigerant circuit 12, the refrigerant communicating pipes 7, 8, 9, and the connection-side refrigerant circuits 14*a*, 14*b*, 14*c*, 14*d* are connected as described above to configure the refrigerant circuit. 10 of the simultaneous-cooling/heating-operation-type air conditioning apparatus 1. This refrigerant circuit 10 includes the compressor 21, the heat-source-side heat exchangers 24, 25, which can be caused to function as evaporators or radiators of the refrigerant, and the usage-side heat exchangers 52*a* to 52*d*, which can be caused to function as evaporators or radiators of the refrigerant. In the simultaneous-cooling/heating-operation-type air conditioning apparatus 1, the unit employed as the heat source unit 2 is a "upward-blowing-type" heat source unit having the exhaust port 2*b* and the outdoor fan 34 in the upper part, having the intake port 2*a* in the side part, and configured so that the air is suctioned into the interior from the intake port 2*a* and the air is exhausted out to the exterior from the exhaust port 2*b*. Inside the heat source unit 2, the heat-source-side heat exchanger is disposed so as to face the intake port 2*a*, and the heat-source-side heat exchanger is divided so as to include the first heat-source-side neat exchanger 24 and the second heat-source-side heat exchanger 25 on the lower side of the first heat-source-side heat exchanger 24. The first heat-source-side flow rate adjusting valve 26, the opening degree of winch is adjustable, is connected to the liquid side of the first heat-source-side neat exchanger 24, and the second heat-source-side flow rate adjusting valve 27, the opening degree of which is adjustable, is connected to the liquid side of the second heat-source-side neat exchanger 25.

(2) Operation of the Refrigeration Apparatus (Simultaneous-Cooling/Heating-Operation-Type Air Conditioning Apparatus)

The operation of the simultaneous-cooling/heating-operation-type air conditioning apparatus 1 will next be described.

The operation modes of the simultaneous-cooling/heating-operation-type air conditioning apparatus 1 can be divided into an air-cooling operation mode, an air-heating operation mode, a simultaneous cooling/beating operation mode (mainly evaporation load), a simultaneous cooling/heating operation mode (mainly radiation load), a simultaneous cooling/heating operation mode (balanced evaporation and radiation load), and a defrost operation mode. In this embodiment, the air-cooling operation mode is an operation mode in which only usage units performing the air-cooling operation (i.e., operation in which the usage-side heat exchanger functions as an evaporator of the refrigerant) are present, and both of the heat-source-side heat exchangers 24, 25 are caused to function as radiators of the refrigerant for the overall evaporation load of the usage units. The air-heating operation mode is an operation mode in which only usage units performing the air-heating operation (i.e., operation in which the usage-side heat exchanger functions as a radiator of the refrigerant) are present, and both of the heat-source-side heat exchangers 24, 25 are caused to function as evaporators of the refrigerant for the overall radiation load of the usage units. The simultaneous cooling/heating operation mode (mainly evaporation load) is an operation mode in which only the first heat-source-side heat exchanger 24 is caused to function as a radiator of the refrigerant for the overall evaporation load of the usage units when there is a mixture of usage units performing the air-cooling operation (i.e., operation in which the usage-side heat exchanger functions as an evaporator of the refrigerant) and usage units performing the air-heating operation (i.e., operation in which the usage-side heat exchanger functions as a radiator of the refrigerant), and the overall heat load of the usage units is mainly an evaporation load. The simultaneous cooling/heating operation mode (mainly radiation load) is an operation mode in which only the first heat-source-side heat exchanger 24 is caused to function as an evaporator of the refrigerant for the overall radiation load of the usage units when there is a mixture of usage units performing the air-cooling operation (i.e., operation in which the usage-side heat exchanger functions as an evaporator of the refrigerant) and usage units performing the air-heating operation (i.e., operation in which the usage-side heat exchanger functions as a radiator of the refrigerant), and the overall heat load of the usage units is mainly a radiation load. The simultaneous cooling/heating operation mode (balanced evaporation and radiation load) is an operation mode in which the first heat-source-side heat exchanger 24 is caused to function as a radiator of the refrigerant and the second heat-source-side heat exchanger 25 is caused to function as an evaporator of the refrigerant when there is a mixture of usage units performing the air-cooling operation (i.e., operation in which the usage-side heat exchanger functions as an evaporator of the refrigerant) and usage units performing the air-heating operation (i.e., operation in which the usage-side heat exchanger functions as a radiator of the refrigerant), and the evaporation load and radiation load of the usage units overall are balanced. The defrost operation mode is an operation mode in which frost on the first and second heat-source-side heat exchangers 24, 25 is melted by stopping the outdoor fan 34 and causing both the heat-source-side heat exchangers 24, 25 to function as radiators of the refrigerant when, similar to the air-heating operation mode, etc., usage units performing the air-heating operation are present, and frost has formed on the first and second heat-source-side heat exchangers 24, 25 due to the first heat-source-side heat exchanger 24 and/or the second heat-source-side heat exchanger 25 being caused to function as evaporators of the refrigerant for the overall heat load of the usage units.

The operation of the simultaneous-cooling/heating-operation-type air conditioning apparatus 1 including these operation modes is performed by the control parts 20, 50*a*, 50*b*, 50*c*, 50*d*, 60*a*, 60*b*, 60*c*, 60*d* described above.

<Air-Cooling Operation Mode>

Figure 4:
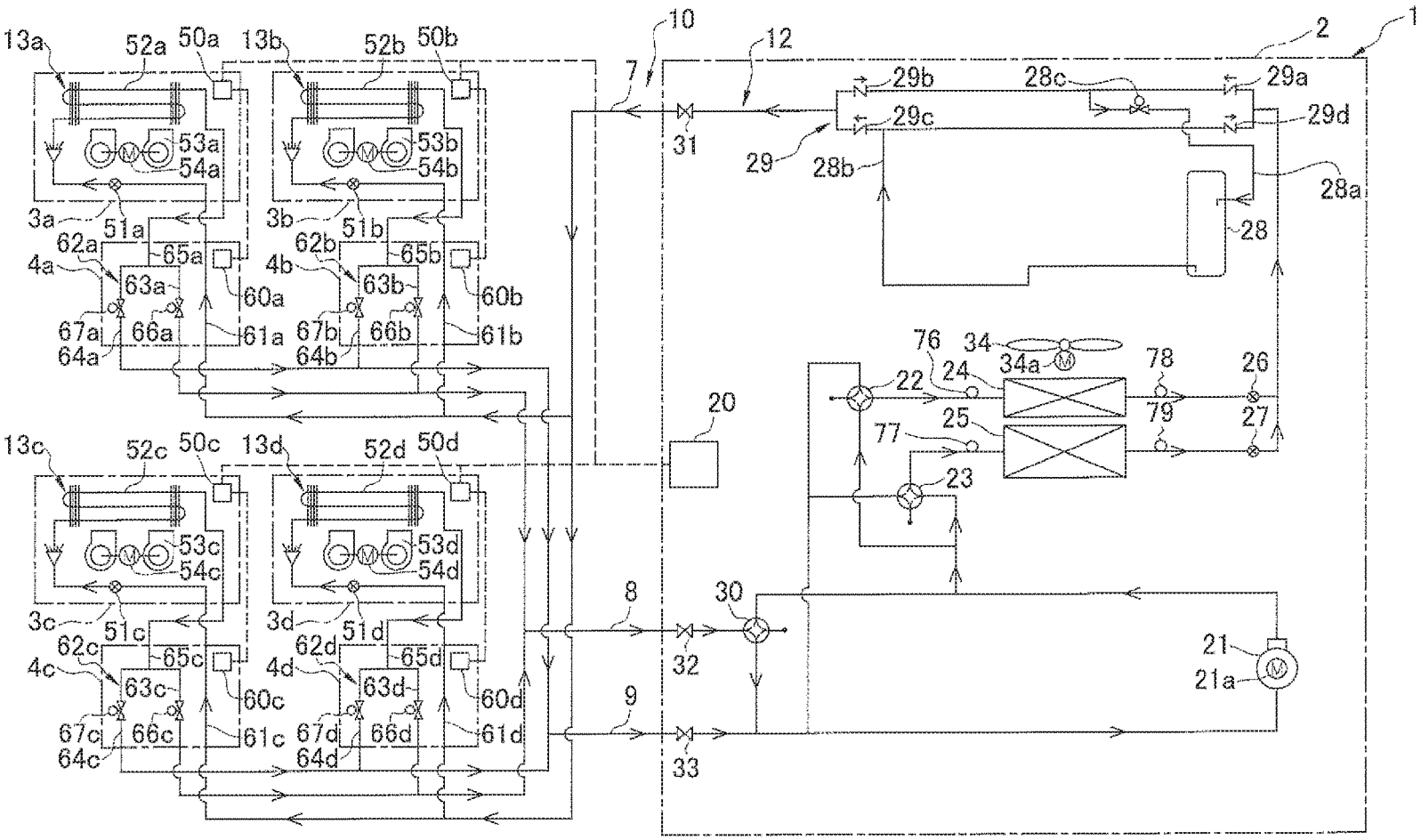
FIG. 4 is a view illustrating operation (refrigerant flow) in an air-cooling operation mode and a defrost operation mode of the simultaneous-cooling/heating-operation-type air conditioning apparatus.

In the air-cooling operation mode, e.g., when all of the usage units 3*a*, 3*b*, 3*c*, 3*d* are performing the air-cooling operation (i.e., operation in which all of the usage-side heat exchangers 52*a*, 52*b*, 52*c*, 52*d* function as evaporators of the refrigerant) and both of the heat-source-side heat exchangers 24, 25 function as radiators of the refrigerant, the refrigerant circuit 10 of the air conditioning apparatus 1 is configured as illustrated in FIG. 4 (see the flow of the refrigerant being illustrated by arrows drawn in the refrigerant circuit 10 in FIG. 4).

Specifically, in the heat-source unit 2, the first heat exchange switching mechanism 22 is switched to the radiating operation state (state indicated by solid lines in the first heat exchange switching mechanism 22 in FIG. 4) and the second heat exchange switching mechanism 23 is switched to the radiating operation state (state indicated by solid lines in the second heat exchange switching mechanism 23 in FIG. 4), whereby both of the heat-source-side heat exchangers 24, 25 are caused to function as radiators of the refrigerant. The high/low pressure switching mechanism 30 is also switched to the evaporation-load operation state (state indicated by solid tines in the high/low pressure switching mechanism 30 in FIG. 4). The opening degrees of the heat-source-side flow rate adjusting valves 26, 27 are also adjusted, and the receiver inlet opening/closing valve 28*c* is open. In the connecting units 4*a*, 4*b*, 4*c*, 4*d*, the high-pressure gas opening/closing valves 66*a*, 66*b*, 66*c*, 66*d* and the low-pressure gas opening/closing valves 67*a*, 67*b*, 67*c*, 67*d* are placed in the open state, whereby all of the usage-side heat exchangers 52*a*, 52*b*, 52*c*, 52*d* of the usage units 3*a*, 3*b*, 3*c*, 3*d* are caused to function as evaporators of the refrigerant, and all of the usage-side heat exchangers 52*a*, 52*b*, 52*c*, 52*d* of the usage units 3*a*, 3*b*, 3*c*, 3*d* and the intake side of the compressor 21 of the heat-source unit 2 are connected via the high/low-pressure gas refrigerant communicating pipe 8 and the low-pressure gas refrigerant communicating pipe 9. In the usage units 3*a*, 3*b*, 3*c*, 3*d*, the opening degrees of the usage-side flow rate adjusting valves 51*a*, 51*b*, 51*c*, 51*d* are adjusted.

In the refrigerant circuit 10 thus configured, high-pressure gas refrigerant compressed and discharged by the compressor 21 is sent to both of the heat-source-side heat exchangers 24, 25 through the heat exchange switching mechanisms 22, 23. The high-pressure gas refrigerant sent to the heat-source-side heat exchangers 24, 25 is then radiated in the heat-source-side heat exchangers 24, 25 by heat exchange with the outdoor air supplied as a heat source by the outdoor fan 34. After the flow rate of the refrigerant radiated in the heat-source-side heat exchangers 24, 25 is adjusted in the heat-source-side flow rate adjusting valves 26, 27, the refrigerant is merged and sent to the receiver 28 through the inlet check valve 29*a* and the receiver inlet opening/closing valve 28*c*. The refrigerant sent to the receiver 28 is temporarily stored in the receiver 28, and is then sent to the liquid refrigerant communicating pipe 7 through the outlet check valve 29*c* and the liquid-side shutoff valve 31.

The refrigerant sent to the liquid refrigerant communicating pipe 7 is branched into four streams and sent to the liquid connecting pipes 61*a*, 61*b*, 61*c*, 61*d* bid of the connecting units 4*a*, 4*b*, 4*c*, 4*d*. The refrigerant sent to the liquid connecting pipes 61*a*, 61*b*, 61*c*, 61*d* is then sent to the usage-side flow rate adjusting valves 51*a*, 51*b*, 51*c*, 51*d* of the usage units 3*a*, 3*b*, 3*c*, 3*d*.

After the flow rate of the refrigerant sent to the usage-side flow rate adjusting valves 51*a*, 51*b*, 51*c*, 51*d* is adjusted in the usage-side flow rate adjusting valves 51*a*, 51*b*, 51*c*, 51*d*, the refrigerant is evaporated in the usage-side heat exchangers 52*a*, 52*b*, 52*c*, 52*d* by heat exchange with the indoor air supplied by the indoor fans 53*a*, 53*b*, 53*c*, 53*d*, and becomes the low-pressure gas refrigerant. Meanwhile, the indoor air is cooled and supplied the indoors, and the air-cooling operation by the usage units 3*a*, 3*b*, 3*c*, 3*d* is performed. The low-pressure gas refrigerant is then sent to the merging gas connecting pipes 65*a*, 65*b*, 65*c*, 65*d* of the connecting units 4*a*, 4*b*, 4*c*, 4*d*.

The low-pressure gas refrigerant sent to the merging gas connecting pipes 65*a*, 65*b*, 65*c*, 65*d* is then sent to the high/low-pressure gas refrigerant communicating pipe 8 through the high-pressure gas opening/closing valves 66*a*, 66*b*, 66*c*, 66*d* and the high-pressure gas connecting pipes 63*a*, 63*b*, 63*c*, 63*d* and merged, and also sent to the low-pressure gas refrigerant communicating pipe 9 through the low-pressure gas opening/closing valves 67*a*, 67*b*, 67*c*, 67*d* and the low-pressure gas connecting pipes 64*a*, 64*b*, 64*c*, 64*d* and merged.

The low-pressure gas refrigerant sent to the gas refrigerant communicating pipes 8, 9 is then returned to the intake Side of the compressor 21 through the gas-side shutoff valves 32, 33 and the high/low pressure switching mechanism 30.

Operation is carried out in this manner in the air-cooling operation mode.

<Air-Heating Operation Mode>

Figure 5:
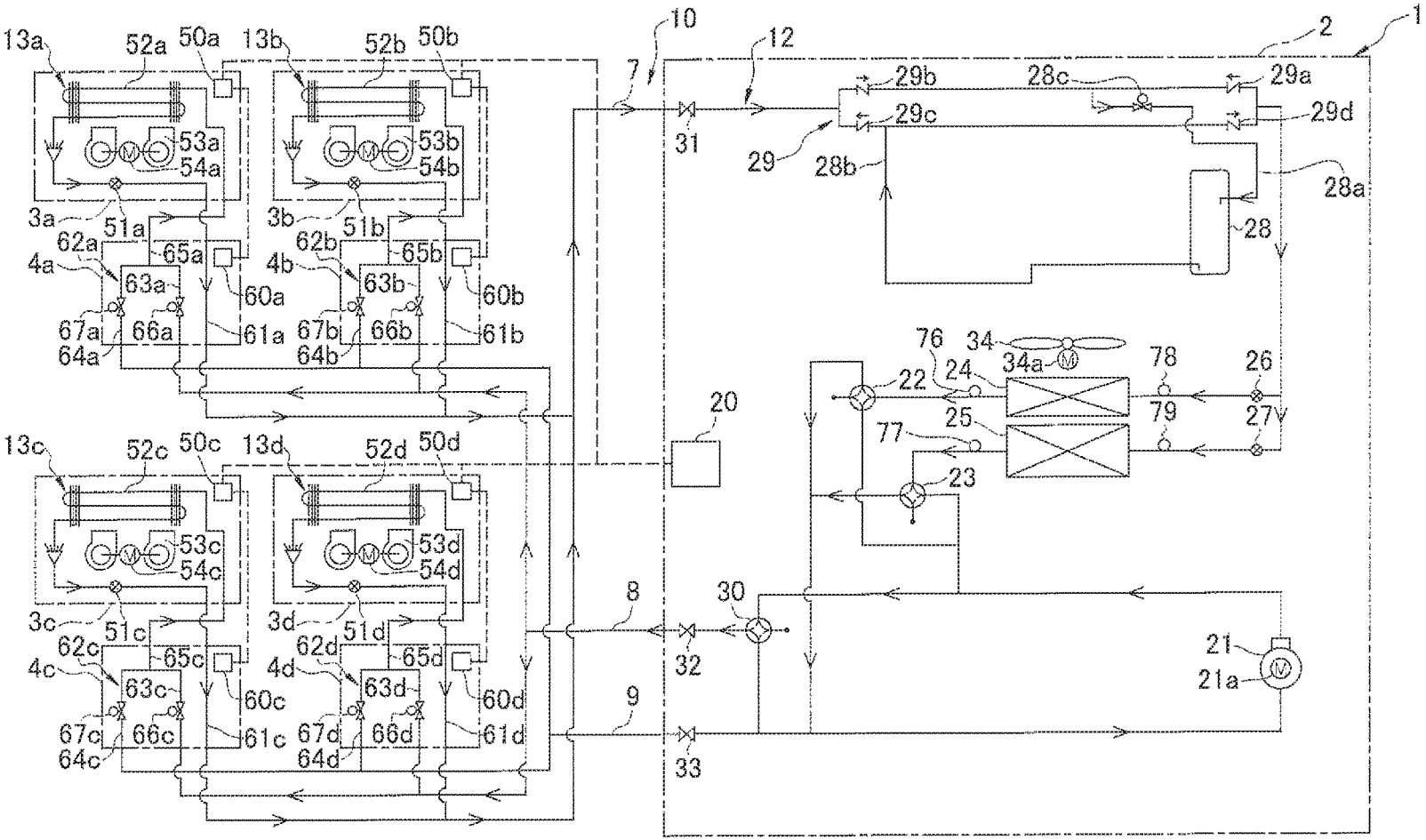
FIG. 5 is a view illustrating operation (refrigerant flow) in an air-heating operation mode of the simultaneous-cooling/heating-operation-type air conditioning apparatus.

In the air-heating operation mode, e.g., when all of the usage units 3*a*, 3*b*, 3*c*, 3*d* are performing the air-heating operation (i.e., operation in which all of the usage-side heat exchangers 52*a*, 52*b*, 52*c*, 52*d* function as radiators of the refrigerant) and both of the heat-source-side heat exchangers 24, 25 function as evaporators of the refrigerant, the refrigerant circuit 10 of the air conditioning apparatus 1 is configured as illustrated in FIG. 5 (see the flow of the refrigerant being illustrated by arrows drawn in the refrigerant circuit 10 in FIG. 5).

Specifically, in the heat-source unit 2, the first heat exchange switching mechanism 22 is switched to die evaporating operation state (state indicated by broken lines in the first heat exchange switching mechanism 22 in FIG. 5) and the second neat exchange switching mechanism 23 is switched to the evaporating operation state (state indicated by broken lines in the second heat exchange switching mechanism 23 in FIG. 5), whereby both of the heat-source-side heat exchangers 24, 25 are caused to function as evaporators of the refrigerant. The high/low pressure switching mechanism 30 is also switched to the radiation-load operation state (state indicated by broken lines in the high/low pressure switching mechanism 30 in FIG. 5). The opening degrees of the heat-source-side flow rate adjusting valves 26, 27 are also adjusted, and the receiver inlet opening/closing valve 28*c* is open. In the connecting units 4*a*, 4*b*, 4*c*, 4*d*, the high-pressure gas opening/closing valves 66*a*, 66*b*, 66*c*, 66*d* are placed in the open state and the low-pressure gas opening/closing valves 67*a*, 67*b*, 67*c*, 67*d* are placed in the closed state, whereby all of the usage-side heat exchangers 52*a*, 52*b*, 52*c*, 52*d* of the usage units 3*a*, 3*b*, 3*c*, 3*d* are caused to function as radiators of the refrigerant, and all of the usage-side heat exchangers 52*a*, 52*b*, 52*c*, 52*d* of the usage units 3*a*, 3*b*, 3*c*, 3*d* and the discharge side of the compressor 21 of the heat-source unit 2 are connected via the high/low-pressure gas refrigerant communicating pipe 8. In the usage units 3*a*, 3*b*, 3*c*, 3*d*, the opening degrees of the usage-side flow rate adjusting valves 51*a*, 51*b*, 51*c*, 51*d* are adjusted.

In the refrigerant circuit 10 thus configured, the high-pressure gas refrigerant compressed and discharged by the compressor 21 is sent to the high/low-pressure gas refrigerant communicating pipe 8 through the high/low pressure switching mechanism 30 and the high/low-pressure-gas-side shutoff valve 32.

The high-pressure gas refrigerant sent to the high/low-pressure gas refrigerant communicating pipe 8 is branched into four streams and sent to the high-pressure gas connecting pipes 63*a*, 63*b*, 63*c*, 63*d* of the connecting units 4*a*, 4*b*, 4*c*, 4*d*. The high-pressure gas refrigerant sent to the high-pressure gas connecting pipes 63*a*, 63*b*, 63*c*, 63*d* is then sent to the usage-side heat exchangers 52*a*, 52*b*, 52*c*, 52*d* of the usage units 3*a*, 3*b*, 3*c*, 3*d* through the high-pressure gas opening/closing valves 66*a*, 66*b*, 66*c*, 66*d* and the merging gas connecting pipes 65*a*, 65*b*, 65*c*, 65*d*.

The high-pressure gas refrigerant sent to the usage-side heat exchangers 52*a*, 52*b*, 52*c*, 52*d* is then radiated in the usage-side heat exchangers 52*a*, 52*b*, 52*c*, 52*d* by heat exchange with the indoor air supplied by the indoor fans 53*a*, 53*b*, 53*c*, 53*d*. Meanwhile, the indoor air is heated and supplied the indoors, and the air-heating operation by the usage units 3*a*, 3*b*, 3*c*, 3*d* is performed. After the flow rate of the refrigerant radiated in the usage-side heat exchangers 52*a*, 52*b*, 52*c*, 52*d* is adjusted in the usage-side flow rate adjusting valves 51*a*, 51*b*, 51*c*, 51*d*, the refrigerant is sent to the liquid connecting pipes 61*a*, 61*b*, 61*c*, 61*d* of the connecting units 4*a*, 4*b*, 4*c*, 4*d*.

The refrigerant sent to the liquid connecting pipes 61*a*, 61*b*, 61*c*, 61*d* is then sent to the liquid refrigerant communicating pipe 7 and merged.

The refrigerant sent to the liquid refrigerant communicating pine 7 is then sent to the receiver 28 through the liquid-side shutoff valve 31, the inlet check valve 29*b*, and the receiver inlet opening/closing valve 28*c*. The refrigerant sent to the receiver 28 is temporarily stored in the receiver 28 and the refrigerant is sent to both of the heat-source-side flow rate adjusting valves 26, 27 through the outlet check valve 29*d*. After the flow rate of the refrigerant sent to the heat-source-side flow rate adjusting valves 26, 27 is adjusted in the heat-source-side flow rate adjusting valves 26, 27, the refrigerant is evaporated in the heat-source-side heat exchangers 24, 25 by heat exchange with the outdoor air supplied by the outdoor fan 34, and becomes the low-pressure gas refrigerant, and is sent to the heat exchange switching mechanisms 22, 23. The low-pressure gas refrigerant sent to the heat exchange switching mechanisms 22, 23 is merged and returned to the intake side of the compressor 21.

Operation is carried out in this manner in the air-heating operation mode.

<Simultaneous Cooling/Heating Operation Mode (Mainly Evaporation Load)>

Figure 6:
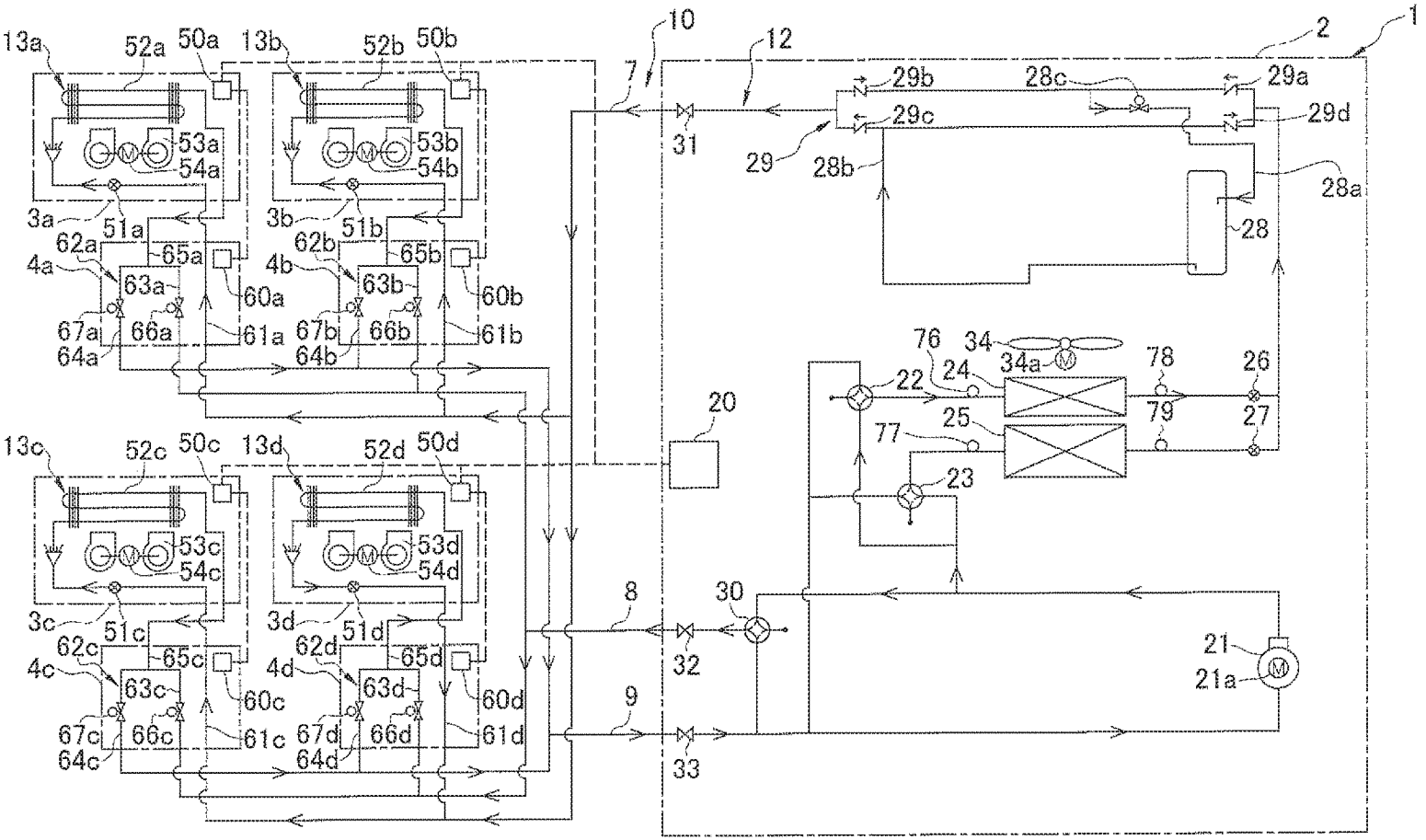
FIG. 6 is a view illustrating operation (refrigerant flow) in a simultaneous cooling/heating operation mode (mainly evaporation load) of the simultaneous-cooling/heating-operation-type air conditioning apparatus

In the simultaneous cooling/heating operation mode (mainly evaporation load), e.g., when the usage units 3*a*, 3*b*, 3*c* are performing the air-cooling operation and the usage unit 3*d* is performing the air-heating operation (i.e., operation in which the usage-side heat exchangers 52*a*, 52*b*, 52*c* function as evaporators of the refrigerant and the usage-side heat exchanger 52*d* functions as a radiator of the refrigerant) and only the first heat-source-side heat exchanger 24 functions as a radiator of the refrigerant, the refrigerant circuit 10 of the air conditioning apparatus 1 is configured as illustrated in FIG. 6 (see the flow of the refrigerant being illustrated by arrows drawn in the refrigerant circuit 10 in FIG. 6).

Specifically, in the heat-source unit 2, the first heat exchange switching mechanism 22 is switched to the radiating operation state (state indicated by solid lines in the first heat exchange switching mechanism 22 in FIG. 6), whereby only the first heat-source-side heat exchanger 24 is caused to function as a radiator of the refrigerant. The high/low pressure switching mechanism 30 is also switched to the radiation-load operation state (state indicated by broken lines in the high/low pressure switching mechanism 30 in FIG. 6). The opening degree of the first heat-source-side flow rate adjusting valve 26 is also adjusted, the second heat-source-side flow rate adjusting valve 27 is closed, and the receiver inlet opening/closing valve 28*c* is open. In the connecting units 4*a*, 4*b*, 4*c*, 4*d*, the high-pressure gas opening/closing valve 66*d* and the low-pressure gas opening/closing valves 67*a*, 67*b*, 67*c* are placed in the open state and the high-pressure gas opening/closing valves 66*a*, 66*b*, 66*c* and the low-pressure gas opening/closing valve 67*d* are placed in the closed state, whereby the usage-side heat exchangers 52*a*, 52*b*, 52*c* of the usage units 3*a*, 3*b*, 3*c* are caused to function as evaporators of the refrigerant, the usage-side heat exchanger 52*d* of the usage unit 3*d* is caused to function as a radiator of the refrigerant, the usage-side heat exchangers 52*a*, 52*b*, 52*c* of the usage units 3*a*, 3*b*, 3*c* and the intake side of the compressor 21 of the heat-source unit 2 are connected via the low-pressure gas refrigerant communicating pipe 9, and the usage-side heat exchanger 52*d* of the usage unit 3*d* and the discharge side of the compressor 21 of the heat-source unit 2 are connected via the high/low-pressure gas refrigerant communicating pipe 8. In the usage units 3*a*, 3*b*, 3*c*, 3*d*, the opening degrees of the usage-side flow rate adjusting valves 51*a*, 51*b*, 51*c*, 51*d* are adjusted.

In the refrigerant circuit 10 thus configured, a portion of the high-pressure gas refrigerant compressed and discharged by the compressor 21 is sent to the high/low-pressure gas refrigerant communicating pipe 8 through the high/low pressure switching mechanism 30 and the high/low-pressure-gas-side shutoff valve 32, and the remainder thereof is sent to the first heat-source-side heat exchanger 24 through the first heat exchange switching mechanism 22.

The high-pressure gas refrigerant sent to the high/low-pressure gas refrigerant communicating pipe 8 is sent to the high-pressure gas connecting pipe 63*d* of the connecting unit 4*d*. The high-pressure gas refrigerant sent to the high-pressure gas connecting pipe 63*d* is sent to the usage-side heat exchanger 52*d* of tire usage unit 3*d* through tire high-pressure gas opening/closing valve 66*d* and the merging gas connecting pipe 65*d*.

The high-pressure gas refrigerant sent to the usage-side heat exchanger 52*d* is then radiated in the usage-side heat exchanger 52*d* by heat exchange with the indoor air supplied by the indoor fan 53*d*. Meanwhile, the indoor air is heated and supplied the indoors, and the air-heating operation by the usage unit 3*d* is performed. After the flow rate of the refrigerant radiated in the usage-side heat exchanger 52*d* is adjusted in the usage-side flow rate adjusting valve 51*d*, the refrigerant is sent to the liquid connecting pipe 61*d* of the connecting unit 4*d*.

The high-pressure gas refrigerant sent to the first heat-source-side heat exchanger 24 is also radiated in the first heat-source-side heat exchanger 24 by heat exchange with the outdoor air supplied as a heat source by the outdoor fan 34. After the flow rate of the refrigerant radiated in the first heat-source-side heat exchanger 24 is adjusted in the first heat-source-side flow rate adjusting valve 26, the refrigerant is sent to the receiver 28 through the inlet check valve 29*a* and the receiver inlet opening/closing valve 28*c*. The refrigerant sent to the receiver 28 is temporarily stored in the receiver 28, and is then sent to the liquid refrigerant communicating pipe 7 through the outlet check valve 29*c* and the liquid-side shutoff valve 31.

The refrigerant radiated in the usage-side heat exchanger 52*d* and sent to the liquid connecting pipe did is then sent to the liquid refrigerant communicating pipe 7, and merged with the refrigerant radiated in the first heat-source-side heat exchanger 24 and sent to the liquid refrigerant communicating pipe 7.

The refrigerant merged in the liquid refrigerant communicating pipe 7 is then branched into three streams and sent to the liquid connecting pipes 61*a*, 61*b*, 61*c* of the connecting units 4*a*, 4*b*, 4*c*. The refrigerant sent to the liquid connecting pipes 61*a*, 61*b*, 61*c* is then sent to the usage-side flow rate adjusting valves 51*a*, 51*b*, 51*c* of the usage units 3*a*, 3*b*, 3*c*.

After the flow rate of the refrigerant sent to the usage-side flow rate adjusting valves 51*a*, 51*b*, 51*c* is adjusted in the usage-side flow rate adjusting valves 51*a*, 51*b*, 51*c*, the refrigerant is evaporated in the usage-side heat exchangers 52*a*, 52*b*, 52*c* by heat exchange with the indoor air supplied by the indoor fans 53*a*, 53*b*, 53*c*, and becomes the low-pressure gas refrigerant. Meanwhile, the indoor air is cooled and supplied the indoors, and the air-cooling operation by the usage units 3*a*, 3*b*, 3*c* is performed. The low-pressure gas refrigerant is then sent to the merging gas connecting pipes 65*a*, 65*b*, 65*c* of the connecting units 4*a*, 4*b*, 4*c*.

The low-pressure gas refrigerant sent to the merging gas connecting pipes 65*a*, 65*b*, 65*c* is then sent to die low-pressure gas refrigerant communicating pipe 9 through the low-pressure gas opening/closing valves 67*a*, 67*b*, 67*c* and the low-pressure gas connecting pipes 64*a*, 64*b*, 64*c* and merged.

The low-pressure gas refrigerant sent to the low-pressure gas refrigerant communicating pipe 9 is then returned to the intake side of the compressor 21 through the low-pressure-gas-side shutoff valve 33.

Operation in the simultaneous cooling/heating operation mode (mainly evaporation load) is performed in the manner described above, in the simultaneous cooling/heating operation mode (mainly evaporation load), the refrigerant is sent from the usage-side heat exchanger 52*d* functioning as a radiator of the refrigerant to the usage-side heat exchangers 52*a*, 52*b*, 52*c* functioning as evaporators of the refrigerant, as described above, whereby heat is recovered between the usage-side heat exchangers 52*a*, 52*b*, 52*c*, 52*d*.

<Simultaneous Cooling/Heating Operation Mode (Mainly Radiation Load)>

Figure 7:
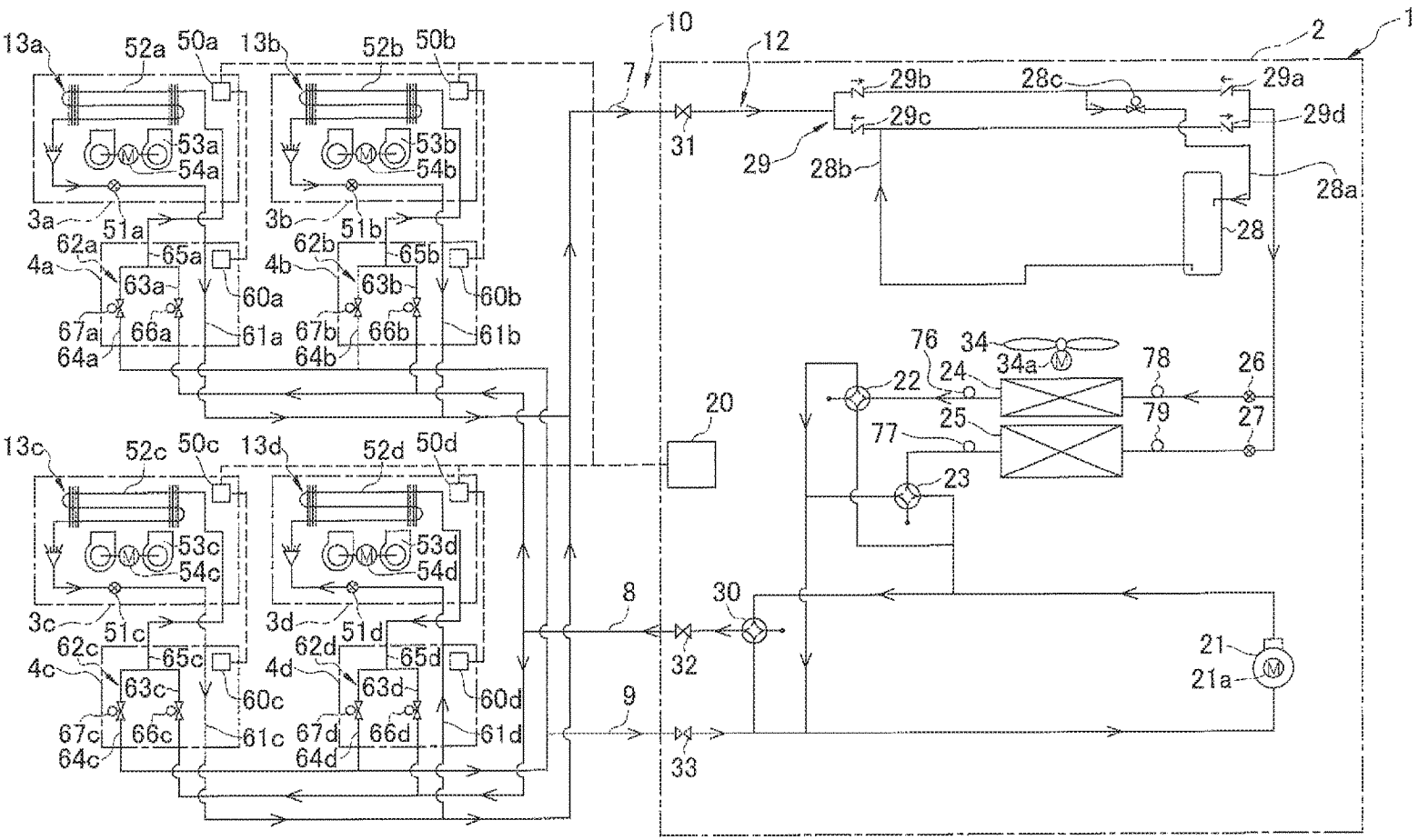
FIG. 7 is a view illustrating operation (refrigerant flow) in a simultaneous cooling/heating operation mode (mainly radiation load) of the simultaneous-cooling/heating-operation-type air conditioning apparatus

In the simultaneous cooling/heating operation mode (mainly radiation load), e.g., when the usage units 3*a*, 3*b*, 3*c* are performing the air-heating operation and the usage unit 3*d* is performing the air-cooling operation (i.e., operation in which the usage-side heat exchangers 52*a*, 52*b*, 52*c* function as radiators of the refrigerant and the usage-side heat exchanger 52*d* functions as an evaporator of the refrigerant) and only the first heat-source-side heat exchanger 24 functions as an evaporator of the refrigerant, the refrigerant circuit 10 of the air conditioning apparatus 1 is configured as illustrated in FIG. 7 (see the flow of the refrigerant being illustrated by arrows drawn in the refrigerant circuit 10 in FIG. 7).

Specifically, in the heat-source unit 2, the first heat exchange switching mechanism 22 is switched to the evaporating operation state (state indicated by broken lines in the first heat exchange switching mechanism 22 in FIG. 7), whereby only the first heat-source-side heat exchanger 24 is caused to function as an evaporator of the refrigerant. The high/low pressure switching mechanism 30 is also switched to the radiation-load operation state (state indicated by broken lines in the high/low pressure switching mechanism 30 in FIG. 7). The opening degree of the first heat-source-side flow rate adjusting valve 26 is also adjusted, the second heat-source-side flow rate adjusting valve 27 is closed, and the receiver inlet opening/closing valve 28*c* is open. In the connecting units 4*a*, 4*b*, 4*c*, 4*d*, the high-pressure gas opening/closing valves 66*a*, 66*b*, 66*c* and the low-pressure gas opening/closing valve 67*d* are placed in the open state and the high-pressure gas opening/closing valve 66*d* and the low-pressure gas opening/closing valves 67*a*, 67*b*, 67*c* are placed in the closed state, whereby the usage-side heat exchangers 52*a*, 52*b*, 52*c* of the usage units 3*a*, 3*b*, 3*c* are caused to function as radiators of the refrigerant, the usage-side heat exchanger 52*d* of the usage unit 3*d* is caused to function as an evaporator of the refrigerant, the usage-side heat exchanger 52*d* of the usage unit 3*d* and the intake side of the compressor 21 of the heat-source unit 2 are connected via the low-pressure gas refrigerant communicating pipe 9, and the usage-side heat exchangers 52*a*, 52*b*, 52*c* of the usage units 3*a*, 3*b*, 3*c* and the discharge side of the compressor 21 of the heat-source unit 2 are connected via the high/low-pressure gas refrigerant communicating pipe 8. In the usage units 3*a*, 3*b*, 3*c*, 3*d*, the opening degrees of the usage-side flow rate adjusting valves 51*a*, 51*b*, 51*c*, 51*d* are adjusted.

In the refrigerant circuit 10 thus configured, the high-pressure gas refrigerant compressed and discharged by the compressor 21 is sent to the high/low-pressure gas refrigerant communicating pipe 8 through the high/low pressure switching mechanism 30 and the high/low-pressure-gas-side shutoff valve 32.

The high-pressure gas refrigerant sent to the high/low-pressure gas refrigerant communicating pipe 8 is then branched into three streams and sent to the high-pressure gas connecting pines 63*a*, 63*b*, 63*c* of the connecting units 4*a*, 4*b*, 4*c*. The high-pressure gas refrigerant sent to the high-pressure gas connecting pipes 63*a*, 63*b*, 63*c* is sent to the usage-side heat exchangers 52*a*, 52*b*, 52*c* of the usage units 3*a*, 3*b*, 3*c* through the high-pressure gas opening/closing valves 66*a*, 66*b*, 66*c* and the merging gas connecting pipes 65*a*, 65*b*, 65*c*.

The high-pressure gas refrigerant sent to the usage-side heat exchangers 52*a*, 52*b*, 52*c* is then radiated in the usage-side heat exchangers 52*a*, 52*b*, 52*c* by heat exchange with the indoor air supplied by the indoor fans 53*a*, 53*b*, 53*c*. Meanwhile, the indoor air is heated and supplied the indoors, and the air-heating operation by the usage units 3*a*, 3*b*, 3*c* is performed. After the flow rate of the refrigerant radiated in the usage-side heat exchangers 52*a*, 52*b*, 52*c* is adjusted in the usage-side flow rate adjusting valves 51*a*, 51*b*, 51*c*, the refrigerant is sent to the liquid connecting pipes 61*a*, 61*b*, 61*c* of the connecting units 4*a*, 4*b*, 4*c*.

The refrigerant sent to the liquid connecting pines 61*a*, 61*b*, 61*c*, 61*d* is then sent to the liquid refrigerant communicating pipe 7 and merged.

A portion of the refrigerant merged in the liquid refrigerant communicating pipe 7 is sent to the liquid connecting pipe 61*d* of the connecting unit 4*d*, and the remainder thereof is sent to the receiver 28 through the liquid-side shutoff valve 31, the inlet check valve 29*b*, and the receiver inlet opening/closing valve 28*c*.

The refrigerant sent to the liquid connecting pipe 61*d* of the connecting unit 4*d* is then sent to the usage-side flow rate adjusting valve 51*d* of the usage unit 3*d*.

After the flow rate of the refrigerant sent to the usage-side flow rate adjusting valve 51*d* is adjusted in the usage-side flow rate adjusting valve 51*d*, the refrigerant is evaporated in the usage-side heat exchanger 52*d* by heat exchange with the indoor air supplied by the indoor fan 53*d*, and becomes the low-pressure gas refrigerant. Meanwhile, the indoor air is cooled and supplied the indoors, and the air-cooling operation by the usage unit 3*d* is performed. The low-pressure gas refrigerant is then sent to the merging gas connecting pipe 65*d* of the connecting unit 4*d*.

The low-pressure gas refrigerant sent to the merging gas connecting pine 65*d* is then sent to the low-pressure gas refrigerant communicating pipe 9 through the low-pressure gas opening/closing valve 67*d* and the low-pressure gas connecting pipe 64*d*.

The low-pressure gas refrigerant sent to the low-pressure gas refrigerant communicating pipe 9 is then returned to the intake side of the compressor 21 through the low-pressure-gas-side shutoff valve 33.

The refrigerant sent to the receiver 28 is temporarily stored in the receiver 28 and the refrigerant is sent to the first heat-source-side flow rate adjusting valve 26 through the outlet check valve 29*d*. After the flow rate of the refrigerant sent to the first heat-source-side flow rate adjusting valve 26 is adjusted in the first heat-source-side flow rate adjusting valve 26, tire refrigerant is evaporated in the first heat-source-side heat exchanger 24 by heat exchange with the outdoor air supplied by the outdoor fan 34, and becomes the low-pressure gas refrigerant, and is sent to the first heat exchange switching mechanism 22. The low-pressure gas refrigerant sent to the first heat exchange switching mechanism 22 is then merged with the low-pressure gas refrigerant returned to the intake side of the compressor 21 through the low-pressure gas refrigerant communicating pipe 9 and tire low-pressure-gas-side shutoff valve 33, and is returned to the intake side of the compressor 21.

Operation in the simultaneous cooling/heating operation mode (mainly radiation load) is performed in the manner described above. In the simultaneous cooling/heating operation mode (mainly radiation load), the refrigerant is sent from the usage-side heat exchangers 52*a*, 52*b*, 52*c* functioning as radiators of the refrigerant to the usage-side heat exchanger 524 functioning as an evaporator of the refrigerant, as described above, whereby heat is recovered between the usage-side heat exchangers 52*a*, 52*b*, 52*c*, 52*d*

<Simultaneous Cooling/Heating Operation Mode (Balanced Evaporation and Radiation Load)>

Figure 8:
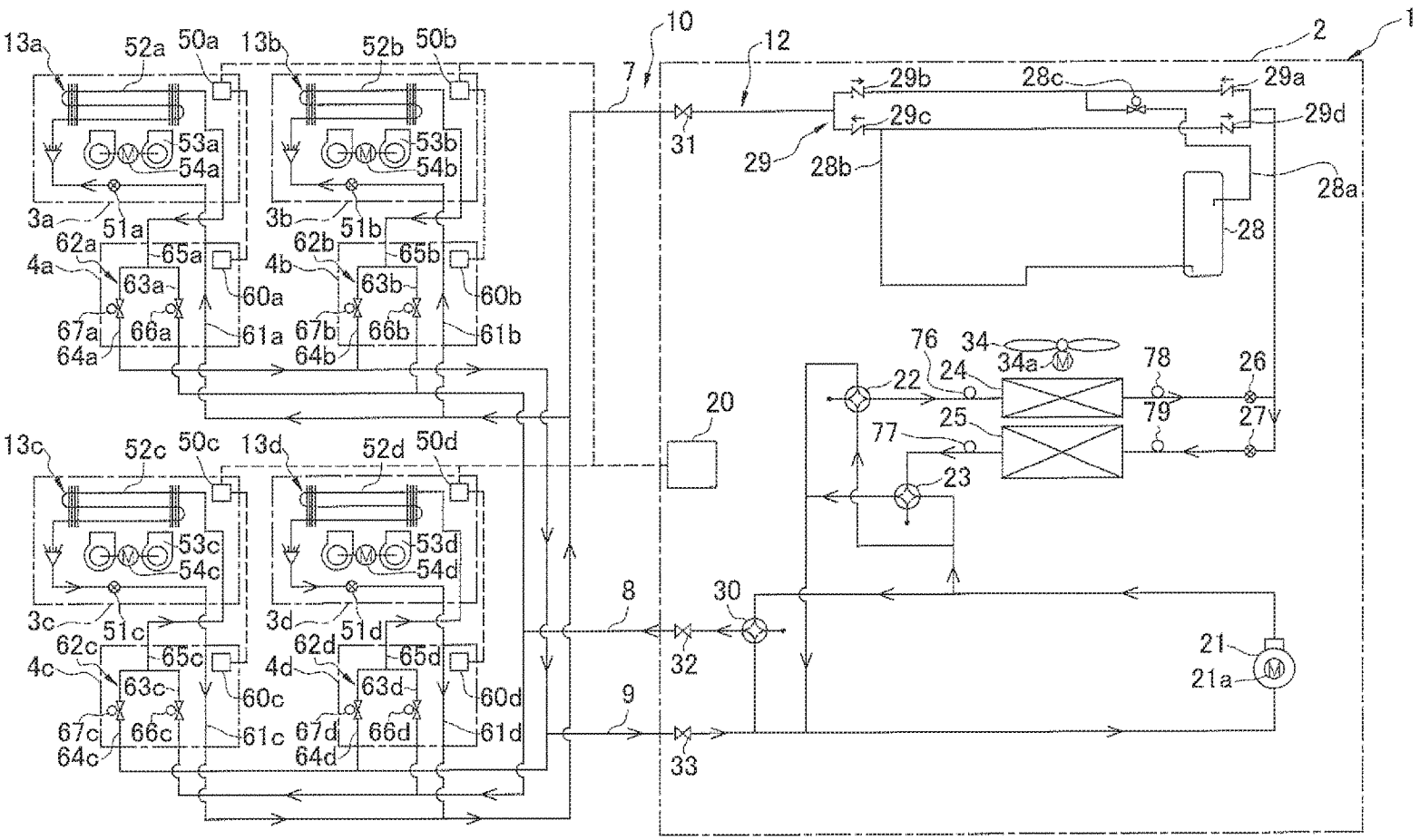
FIG. 8 is a view illustrating operation (refrigerant flow) in a simultaneous cooling/heating operation mode (balanced evaporation and radiation load) of the simultaneous-cooling/heating-operation-type air conditioning apparatus

In the simultaneous cooling/heating operation mode (balanced evaporation and radiation load), e.g., when the usage units 3*a*, 3*b* are performing the air-cooling operation and the usage units 3*c*, 3*d* are performing the air-heating operation (i.e., operation in which the usage-side heat exchangers 52*a*, 52*b* function as evaporators of the refrigerant and the usage-side heat exchangers 52*c*, 52*d* function as radiators of the refrigerant), the first heat-source-side heat exchanger 24 functions as a radiator of the refrigerant, and the second heat-source-side heat exchanger 25 functions as an evaporator of the refrigerant, the refrigerant circuit 10 of the air conditioning apparatus 1 is configured as illustrated in FIG. 8 (see the flow of the refrigerant being illustrated by arrows drawn in the refrigerant circuit. 10 in FIG. 8).

Specifically, in the heat-source unit 2, the first heat exchange switching mechanism 22 is switched to the radiating operation state (state indicated by solid lines in the first heat exchange switching mechanism 22 in FIG. 8) and the second heat exchange switching mechanism 23 is switched to the evaporating operation state (state indicated by broken lines in the second heat exchange switching mechanism 23 in FIG. 8), whereby the first heat-source-side heat exchanger 24 is caused to function as a radiator of the refrigerant and the second heat-source-side heat exchanger 25 is caused to function as an evaporator of the refrigerant. The high/low pressure switching mechanism 30 is also switched to the radiation-load operation state (state indicated by broken lines in the high/low pressure switching mechanism 30 in FIG. 8). The opening degrees of the heat-source-side flow rate adjusting valves 26, 27 are also adjusted. In the connecting units 4*a*, 4*b*, 4*c*, 4*d*, the high-pressure gas opening/closing valves 66*c*, 66*d* and the low-pressure gas opening/closing valves 67*a*, 67*b* are placed in the open state, and the high-pressure gas opening/closing valves 66*a*, 66*b* and the low-pressure gas opening/closing valves 67*c*, 67*d* are placed in the closed state, whereby the usage-side heat exchangers 52*a*, 52*b* of the usage units 3*a*, 3*b* are caused to function as evaporators of die refrigerant, the usage-side heat exchangers 52*c*, 52*d* of the usage units 3*c*, 3*d* are caused to function as radiators of the refrigerant, the usage-side heat exchangers 52*a*, 52*b* of the usage units 3*a*, 3*b* and the intake side of the compressor 21 of the heat-source unit 2 are connected via the low-pressure gas refrigerant communicating pipe 9, and the usage-side heat exchangers 52*c*, 52*d* of the usage units 3*c*, 3*d* and the discharge side of the compressor 21 of the heat-source unit 2 are connected via the high/low-pressure gas refrigerant communicating pipe 8. In the usage units 3*a*, 3*b*, 3*c*, 3*d*, the opening degrees of the usage-side flow rate adjusting valves 51*a*, 51*b*, 51*c*, 51*d* are adjusted.

In the refrigerant circuit 10 thus configured, a portion of the high-pressure gas refrigerant compressed and discharged by the compressor 21 is sent to the high/low-pressure gas refrigerant communicating pipe 8 through the high/low pressure switching mechanism 30 and the high/low-pressure-gas-side shutoff valve 32, and the remainder thereof is sent to the first heat-source-side heat exchanger 24 through the first heat exchange switching mechanism 22.

The high-pressure gas refrigerant sent to the high/low-pressure gas refrigerant communicating pipe 8 is then sent to the high-pressure gas connecting pipes 63*c*, 63*d* of the connecting units 4*c*, 4*d*. The high-pressure gas refrigerant sent to the high-pressure gas connecting pipes 63*c*, 63*d* is sent to the usage-side heat exchangers 52*c*, 52*d* of the usage units 3c, 3d through the high-pressure gas opening/closing valves 66c, 66d and the merging gas connecting pipes 65c, 65d.

The high-pressure gas refrigerant sent to the usage-side heat exchangers 52c, 52d is then radiated in the usage-side heat exchangers 52c, 52d by heat exchange with the indoor air supplied by the indoor fans 53c, 53d. Meanwhile, the indoor air is heated and supplied the indoors, and the air-heating operation by the usage units 3c, 3d is performed. After the flow rate of the refrigerant radiated in the usage-side heat exchangers 52c, 52d is adjusted in the usage-side flow rate adjusting valves 51c, 51d, the refrigerant is sent to the liquid connecting pipes 61c, 61d of the connecting units 4c, 4d.

The refrigerant radiated in the usage-side heat exchangers 52c, 52d and sent to the liquid connecting pipes 61c, 61d is then sent to the liquid refrigerant communicating pipe 7 and merged.

The refrigerant merged in the liquid refrigerant communicating pipe 7 is then branched into two streams and sent to the liquid connecting pipes 61a, 61b of the connecting units 4a, 4b. The refrigerant sent to the liquid connecting pipes 61a, 61b is then sent to the usage-side flow rate adjusting valves 51a, 51b of the usage units 3a, 3b.

After the flow rate of the refrigerant sent to the usage-side flow rate adjusting valves 51a, 51b is adjusted in the usage-side flow rate adjusting valves 51a, 51b, the refrigerant is evaporated in the usage-side heat exchangers 52a, 52b by heat exchange with the indoor air supplied by the indoor fans 53a, 53b, and becomes the low-pressure gas refrigerant. Meanwhile, the indoor air is cooled and supplied the indoors, and the air-cooling operation by the usage units 3a, 3b is performed. The low-pressure gas refrigerant is then sent to the merging gas connecting pipes 65a, 65b of the connecting units 4a, 4b.

The low-pressure gas refrigerant sent to the merging gas connecting pipes 65a, 65b is then sent to the low-pressure gas refrigerant communicating pipe 9 through the low-pressure gas opening/closing valves 67a, 67b and the low-pressure gas connecting pipes 64a, 64b and merged.

The low-pressure gas refrigerant sent to the low-pressure gas refrigerant communicating pipe 9 is then returned to the intake side of the compressor 21 through the low-pressure-gas-side shutoff valve 33.

The high-pressure gas refrigerant sent to the first heat-source-side heat exchanger 24 is also radiated in the first heat-source-side heat exchanger 24 by heat exchange with the outdoor air supplied as a heat source by the outdoor fan 34. The refrigerant radiated in the first heat-source-side heat exchanger 24 then passes through the first heat-source-side flow rate adjusting valve 26, after which almost all thereof is sent to the second heat-source-side flow rate adjusting valve 27. Therefore, the refrigerant radiated in the first heat-source-side heat exchanger 24 is not sent to the liquid refrigerant communicating pipe 7 through the receiver 28, the bridge circuit 29, and the liquid-side shutoff valve 31. After the flow rate of the refrigerant sent to the second heat-source-side flow rate adjusting valve 27 is adjusted in the second heat-source-side flow rate adjusting valve 27, the refrigerant is evaporated in the second heat-source-side heat exchanger 25 by heat exchange with the outdoor air supplied by the outdoor fan 34, becomes the low-pressure gas refrigerant and is sent to the second heat exchange switching mechanism 23. The low-pressure gas refrigerant sent to the second heat exchange switching mechanism 23 is then merged with the low-pressure gas refrigerant returned to the intake side of the compressor 21 through the low-pressure gas refrigerant communicating pipe 9 and tire gas-side shutoff valve 33, and is returned to the intake side of the compressor 21.

Operation is carried out in this manner in the simultaneous cooling/heating operation mode (balanced evaporation and radiation load) In tire simultaneous cooling/heating operation mode (balanced evaporation and radiation load), the refrigerant is sent from the usage-side heat exchangers 52c, 52d functioning as radiators of the refrigerant to the usage-side heat exchangers 52a, 52b functioning as evaporators of the refrigerant, as described above, whereby heat is recovered between the usage-side heat exchangers 52a, 52b, 52c, 52d. Also in the simultaneous cooling/heating operation mode (balanced evaporation and radiation load), the first heat-source-side heat exchanger 24 is caused to function as a radiator of the refrigerant and the second heat-source-side heat exchanger 25 is caused to function as an evaporator of the refrigerant, as described above, whereby a correspondence is performed that causes the evaporation load and the radiation load of the two heat-source-side heat exchangers 24, 25 to counterbalance each other.

<Defrost Operation Mode>

During the defrost operation mode, e.g., when all of the usage units 3a, 3b, 3c, 3d perform the air-cooling operation (i.e., operation in which all of the usage-side heat exchangers 52a, 52b, 52c, 52d function as evaporators of the refrigerant) and both of the heat-source-side heat exchangers 24, 25 function as radiators of the refrigerant, the refrigerant circuit 10 of the air conditioning apparatus 1 is configured as illustrated in FIG. 4 (see the flow of the refrigerant being illustrated by arrows drawn in the refrigerant circuit 10 in FIG. 4), similar to the air-cooling operation mode.

Specifically, in the heat-source unit 2, the first heat exchange switching mechanism 22 is switched to the radiating operation state (state indicated by solid lines in the first heat exchange switching mechanism 22 in FIG. 4) and the second heat exchange switching mechanism 23 is switched to the radiating operation state (state indicated by solid lines in the second heat exchange switching mechanism 23 in FIG. 4), whereby both of the heat-source-side heat exchangers 24, 25 are caused to function as radiators of the refrigerant. The high/low pressure switching mechanism 30 is also switched to the evaporation-load operation state (state indicated by solid lines in the high/low pressure switching mechanism 30 in FIG. 4). The opening degrees of the heat-source-side flow rate adjusting valves 26, 27 are also adjusted, and the receiver inlet opening/closing valve 28c is open. In the connecting units 4a, 4b, 4c, 4d, the high-pressure gas opening/closing valves 66a, 66b, 66c, 66d and the low-pressure gas opening/closing valves 67a, 67b, 67c, 67d are placed in the open state, whereby all of the usage-side heat exchangers 52a, 52b, 52c, 52d of the usage units 3a, 3b, 3c, 3d are caused to function as evaporators of the refrigerant, and all of the usage-side heat exchangers 52a, 52b, 52c, 52d of the usage units 3a, 3b, 3c, 3d and the intake side of the compressor 21 of the heat-source unit 2 are connected via the high/low-pressure gas refrigerant communicating pipe 8 and the low-pressure gas refrigerant communicating pipe 9. In the usage units 3a, 3b, 3c, 3d, the opening degrees of the usage-side flow rate adjusting valves 51a, 51b, 51c, 51d are adjusted.

In the defrost operation mode, unlike the air-cooling operation mode, the outdoor fan 34 is stopped and the indoor fans 53a, 53b, 53c, 53d are either stopped or operated at a low air flow rate.

In the refrigerant circuit 10 thus configured, the high-pressure gas refrigerant compressed and discharged by the compressor 21 is sent to both of the heat-source-side heat exchangers 24, 25 through the heat exchange switching mechanisms 22, 23. The high-pressure gas refrigerant sent to the heat-source-side heat exchangers 24, 25 radiates heat in the heat-source-side heat exchangers 24, 25 primarily due to the melting of the frost on the heat-source-side heat exchangers 24, 25, because the outdoor fan 34 has been stopped. After the flow rate of the refrigerant radiated in the heat-source-side heat exchangers 24, 25 is adjusted in the heat-source-side flow rate adjusting valves 26, 27, the refrigerant is merged and sent to the receiver 28 through the inlet check valve 29*a* and the receiver inlet opening/closing valve 28*c*. The refrigerant sent to the receiver 28 is temporarily stored in the receiver 28, and is then sent to the liquid refrigerant communicating pipe 7 through the outlet check valve 29*c* and the liquid-side shutoff valve 31.

The refrigerant sent to the liquid refrigerant communicating pipe 7 is branched into four streams and sent to the liquid connecting pipes 61*a*, 61*b*, 61*c*, 61*d* of the connecting units 4*a*, 4*b*, 4*c*, 4*d*. The refrigerant sent to the liquid connecting pipes 61*a*, 61*b*, 61*c*, 61*d* is then sent to the usage-side flow rate adjusting valves 51*a*, 51*b*, 51*c*, 51*d* of the usage units 3*a*, 3*b*, 3*c*, 3*d*.

After the flow rate of the refrigerant sent to the usage-side flow rate adjusting valves 51*a*, 51*b*, 51*c*, 51*d* is adjusted in the usage-side flow rate adjusting valves 51*a*, 51*b*, 51*c*, 51*d*, the refrigerant evaporates into the low-pressure gas refrigerant in the usage-side heat exchangers 52*a*, 52*b*, 52*c*, 52*d* by exchanging heat somewhat with the indoor air, because the indoor fans 53*a*, 53*b*, 53*c*, 53*d* have either been stopped or are being operated at the low air flow rate. The low-pressure gas refrigerant is then sent to the merging gas connecting pipes 65*a*, 65*b*, 65*c*, 65*d* of the connecting units 4*a*, 4*b*, 4*c*, 4*d*.

The low-pressure gas refrigerant sent to the merging gas connecting pipes 65*a*, 65*b*, 65*c*, 65*d* is then sent to the high/low-pressure gas refrigerant communicating pipe 8 through the high-pressure gas opening/closing valves 66*a*, 66*b*, 66*c*, 66*d* and the high-pressure gas connecting pipes 63*a*, 63*b*, 63*c*, 63*d* and merged, and also sent to the low-pressure gas refrigerant communicating pipe 9 through the low-pressure gas opening/closing valves 67*a*, 67*b*, 67*c*, 67*d* and the low-pressure gas connecting pipes 64*a*, 64*b*, 64*c*, 64*d* and merged.

The low pressure gas refrigerant sent to the gas refrigerant communicating pipes 8, 9 is then returned to the intake side of the compressor 21 through the gas-side shutoff valves 32, 33 and the high/low pressure switching mechanism 30.

Operation is earned out in this manner in the defrost operation mode, hi the defrost operation mode, the first and second heat-source-side heat exchangers 24, 25 are defrosted by stopping the outdoor fan 34 and causing the first and second heat-source-side heat exchangers 24, 25 to function as radiators of the refrigerant, as described above.

(3) Control of Heat-Source-Side Flow Rate Adjusting Valves

In the simultaneous-cooling/heating-operation-type air conditioning apparatus 1, the configuration is employed in which, as described above, the vertically divided heat-source-side heat exchangers 24, 25 are disposed so as to face the intake port 2*a* on the side part within the upward-blowing-type heat source unit 2, and the sizes of the headers 24*a*, 25*a* and/or the flow dividers 24*b*, 25*b* and the opening sizes (or rated Cv values) of the heat-source-side flow rate adjusting valves 26, 27 are designed while taking into account the air flow rate distribution achieved by employing this configuration (the flow rate distribution with which the air flows readily to the upper-side first heat-source-side heat exchanger 24), so that the refrigerant flows readily to the first heat-source-side heat exchanger 24 and the refrigerant does not flow readily to the lower-side second heat-source-side heat exchanger 25.

Therefore, in the operation modes except for the defrost operation mode (the air-cooling operation mode, the air-heating operation mode, etc.), the desired performance is readily achieved because the air flow rate distribution achieved by employing the upward-blowing-type heat source unit as the heat source unit 2 (the flow rate distribution with which the air flows readily to the upper-side first heat-source-side heat exchanger 24) is taken into account. For example, in the air-cooling operation mode, it is possible to achieve a flow rate appropriate for both the heat-source-side heat exchangers 24, 25, corresponding to the air flow rate distribution with which the air flows readily to the upper-side first heat-source-side heat exchanger 24, by controlling the opening degrees of both the heat-source-side flow rate adjusting valves 26, 27 to fully open (−100% opening degree, rated Cv value), and the desired radiation performance is thereby readily achieved.

However, in the defrost operation mode performed when the frost has formed on the first and second heat-source-side heat exchangers 24, 25 due to the air-heating operation mode or the like, the design that hinders the flow of the refrigerant to the second heat-source-side heat exchanger 25 causes the liquid refrigerant to readily accumulate in the second heat-source-side heat exchanger 25 and the speed at which the frost melts in the second heat-source-side heat exchanger 25 to decrease, and the defrost time therefore tends to be longer.

In view of this, opening degree control for the first and second heat-source-side flow rate adjusting valves 26, 27, such as is described below, is performed in the defrost operation mode in this embodiment.

Figure 9:
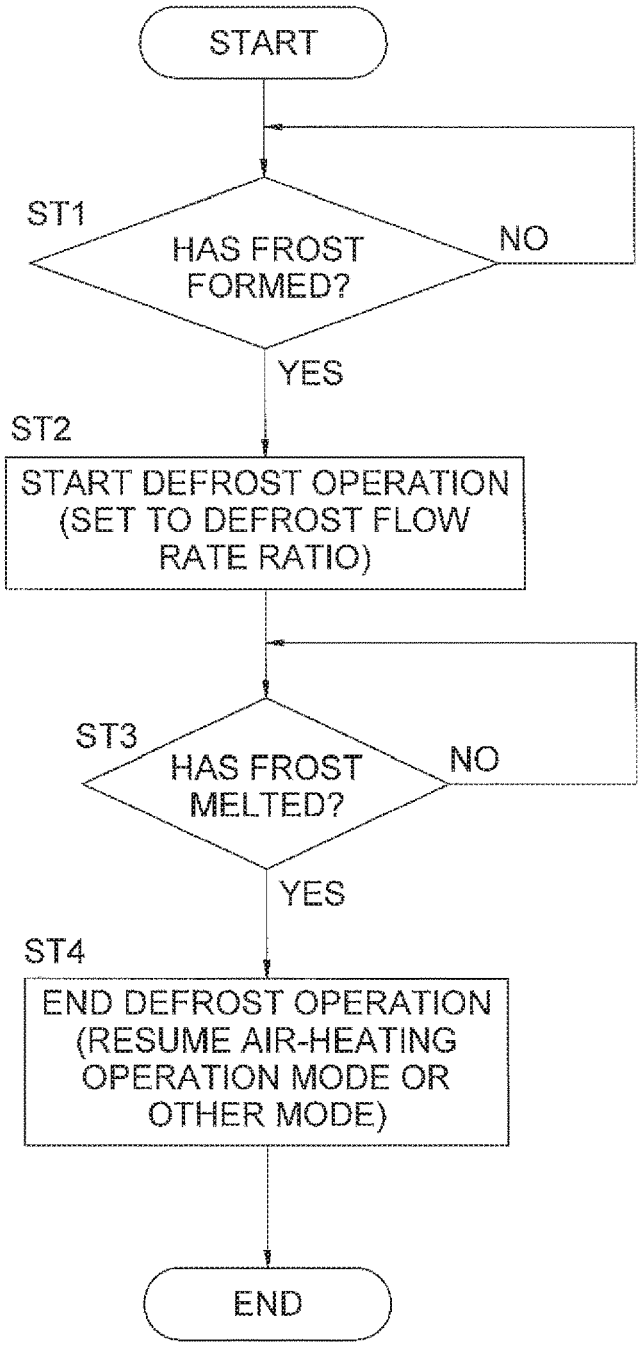
FIG. 9 is a flowchart of the defrost operation mode.

Next, FIG. 9 is used to describe the opening degree control for the heat-source-side flow rate adjusting valves 26, 27 in the defrost operation mode. FIG. 9 is a flowchart of the defrost operation mode. The operation of the defrost operation mode including the opening degree control for the heat-source-side flow rate adjusting valves 26, 27 is performed by the control parts 20, 50*a*, 50*b*, 50*c*, 50*d*, 60*a*, 60*b*, 60*c*, 60*d*.

First, in step ST1, a determination is made as to whether or not frost has formed on the first and second heat-source-side heat exchangers 24, 25 due to an operation, such as the air-heating operation mode, in which the first heat-source-side heat exchanger 24 and/or the second heat-source-side heat exchanger 25 is caused to function as an evaporator of the refrigerant. In this embodiment, whether or not frost has formed on the first and second heat-source-side heat exchangers 24, 25 is determined on the basis of the refrigerant temperature detected by the gas-side temperature sensors 76, 77 and/or the liquid-side temperature sensors 78, 79. Specifically, the determination is made according to whether or not the gas-side temperature sensors 76, 77 and/or the liquid-side temperature sensors 78, 79 have fallen to or below a predetermined temperature. When it is determined in step ST1 that the frost has formed on the first and second heat-source-side heat exchangers 24, 25, the sequence transitions to the process of step ST2.

Next, in step ST2, both of the heat-source-side heat exchangers 24, 25 are caused to function as radiators of the refrigerant by switching both or one of the heat exchange switching mechanisms 22, 23 from the evaporating operation state to the radiating operation state, and ail or some of the usage-side heat exchangers 52*a*, 52*b*, 52*c*, 52*d* of the usage units 3*a*, 3*b*, 3*c*, 3*d* are caused to function as evaporators of the refrigerant by opening all or some of the high-pressure gas opening/closing valves 66*a*, 66*b*, 66*c*, 66*d* and the low-pressure gas opening/closing valves 67*a*, 67*b*, 67*c*, 67*d*, whereby the same refrigerant flow as in the air-cooling operation mode is achieved. Unlike the air-cooling operation mode, however, the outdoor fan 34 is stopped and the indoor fans 53*a*, 53*b*, 53*c*, 53*d* are either stopped or operated at the low air flow rate. As for the heat-source-side flow rate adjusting valves 26, 27, what is similar to the air-cooling operation mode is that the opening degrees of these valves are both controlled to fully open (=400% opening degree, rated Cv value), but what is different from the air-cooling operation mode is that the opening degrees of the first and second heat-source-side flow rate adjusting valves 26, 27 are controlled so as to yield a defrost flow rate ratio, which is a flow rate ratio in which more refrigerant flows to the second heat-source-side heat exchanger 25 than during the air-cooling operation mode, for example, when the flow rate ratio between the flow rate of tire refrigerant flowing through the first heat-source-side heat exchanger 24 and the flow rate of the refrigerant flowing through the second heat-source-side heat exchanger 25 in the air-cooling operation mode is 3.7 (both of the heat-source-side flow rate adjusting valves 26, 27 being fully open at this time), the opening degrees of the first and second heat-source-side flow rate adjusting valves 26, 27 are controlled so that the flow rate ratio between the flow rate of the refrigerant flowing through the first heat-source-side heat exchanger 24 and the flow rate of the refrigerant flowing through the second heat-source-side heat exchanger 25 in the defrost operation mode (the defrost flow rate ratio) reaches 2:8 or some other flow rate ratio that is less than 3 to at least 7. Specifically, the defrost flow rate ratio described above is achieved by setting the second heat-source-side flow rate adjusting valve 27 to fully open (=100% opening degree, rated Cv value), and setting the first heat-source-side flow rate adjusting valve 26 to an opening degree (e.g., 70-80% opening degree) that is less than the opening degree (fully open in the present embodiment) during the air-cooling operation mode. In this embodiment, the opening degrees of the first and second heat-source-side flow rate adjusting valves 26, 27 are set to opening degrees at which the defrost flow rate ratio is obtained when the defrost operation is started as described above, and are maintained at the opening degrees set for when the defrost operation is started until the defrost operation ends in steps ST3 and ST4 described below. The flow rate ratio in the air-cooling operation mode is not limited to the aforementioned 3.7, and may be set to various flow rate ratios depending on the air flow rate distribution and/or the relationship of the heat transfer areas of the heat-source-side heat exchangers 24, 25. Therefore, the defrost flow rate ratio also may be set in accordance with the flow rate ratio in the air-cooling operation mode, to various flow rate ratios within a range that would yield a flow rate ratio such that more refrigerant flows to the second heat-source-side heat exchanger 25 than during the air-cooling operation mode. In this manner is the defrost operation started.

Next, in step ST3, a determination is made as to whether or not the frost on the first and second heat-source-side neat exchangers 24, 25 has melted. In this embodiment, whether or not the frost on the first and second heat-source-side heat exchangers 24, 25 has melted is determined on the basis of the refrigerant temperature detected by the gas-side temperature sensors 76, 77 and/or the liquid-Side temperature sensors 78, 79. Specifically, the determination is made according to whether or not the gas-side temperature sensors 76, 77 and/or the liquid-side temperature sensors 78, 79 have risen to or above a predetermined temperature. When it is determined in step ST3 that the frost on the first and second heat-source-side neat exchangers 24, 25 has melted, the sequence transitions to the process of step ST4, the defrost operation mode is ended, and the air-heating operation mode or another operation mode is resumed.

In this manner, the operation of the defrost operation mode including the opening degree control for the heat-source-side flow rate adjusting valves 26, 27 is performed.

With the opening degree control for the heat-source-side flow rate adjusting valves 26, 27 in the defrost operation mode described above, the flow rate of the refrigerant passing through the second heat-source-side heat exchanger 25 can be made greater in the defrost operation mode than the flow rate during the air-cooling operation mode. Therefore, in this embodiment, the liquid refrigerant does not readily accumulate inside the second heat-source-side heat exchanger 25, and the speed with which the frost is melted can be increased in the second heat-source-side heat exchanger 25.

The frost on the upper and lower heat-source-side heat exchangers 24, 25 can thereby be melted simultaneously during the defrost operation mode in this embodiment, and defrost time can be shortened. Because the liquid refrigerant does not readily accumulate inside the second heat-source-side heat exchanger 25, a backflow of the liquid refrigerant from the second heat-source-side heat exchanger 25 to the compressor 21 can be suppressed when the air-heating operation mode, or another operation mode in which the second heat-source-side heat exchanger 25 is caused to function as an evaporator of the refrigerant, is resumed after the defrost operation mode.

In the defrost operation mode in this embodiment, a situation can be created in which the refrigerant flows as readily as possible to the second heat-source-side heat exchanger 25 by setting the second heat-source-side flow rate adjusting valve 27 to fully open, and the flow rate of the refrigerant flowing through the second heat-source-side heat exchanger 25 can be reliably increased by setting the first heat-source-side flow rate adjusting valve 26 to an opening degree less than the opening degree during the air-cooling operation mode.

The defrost flow rate ratio can thereby be reliably achieved in the defrost operation in this embodiment.

In this embodiment when the opening degrees of the first and second heat-source-side flow rate adjusting valves 26, 27 are changed during the defrost operation, the refrigerant sometimes accumulates readily in the heat-source-side heat exchanger corresponding to the heat-source-side flow rate adjusting valve of which the opening degree has become relatively small, and should such an accumulation of the refrigerant occur, there is a risk that the liquid refrigerant will readily flow back to the compressor 21 from the heat-source-side heat exchanger having this refrigerant accumulation when the defrost operation is ended and the air-heating operation, or another operation mode in which the heat-source-side heat exchanger is caused to function as an evaporator of the refrigerant, is resumed.

However, in this embodiment, the defrost operation is performed without changing the opening degrees of the first and second heat-source-side flow rate adjusting valves 26, 27 from the start of the defrost operation until the end, as described above.

Control during the defrost operation is thereby simplified in this embodiment, and the liquid backflow after the defrost operation has ended can also be suppressed (4) Modifications The configuration of the simultaneous-cooling/heating-operation-type air conditioning apparatus 1 is described in the above embodiment as an example of a refrigeration apparatus to which the present invention is applied, but the present invention is not limited to this configuration. For example, the present invention can also be applied to a refrigeration apparatus other than a cooling/heating-switching-operation-type air conditioning apparatus or the like, if the apparatus is configured such that vertically divided heat-source-side heat exchangers are disposed inside an upward-blowing-type heat source unit.

Two vertically divided heat-source-side heat exchangers 24, 25 are employed as the heat-source-side heat exchanger in the above embodiment, but such an arrangement is not provided by way of limitation. For example, three or more vertically divided heat-source-side heat exchangers may be employed. In the present embodiment, the same operational effects as the above embodiment can be achieved by controlling the opening degrees of the heat-source-side flow rate adjusting valves corresponding to at least two of the plurality (three or more) of heat-source-side heat exchangers in the defrost operation so that the defrost flow rate ratio described above is achieved in those heat-source-side heat exchangers.

INDUSTRIAL APPLICABILITY

The present invention is widely applicable to refrigeration apparatuses in which vertically divided heat-source-side heat exchangers are disposed inside an upward-blowing-type heat source unit.

What is claimed is:

1. A refrigeration apparatus comprising:

a compressor;

a heat-source-side heat exchanger operable as an evaporator or a radiator of a refrigerant;

a usage-side heat exchanger operable as an evaporator or a radiator of the refrigerant; and a controller programmed to perform a defrost operation, the heat-source-side heat exchanger being disposed inside a heat source unit having an exhaust port and an outdoor fan in an upper part, and an intake port in a side part, the heat-source-side heat exchanger being configured so as to suction air into an interior from the intake port and to exhaust air out to an exterior from the exhaust port, the heat-source-side heat exchanger being disposed so as to face the intake port, and the heat-source-side heat exchanger being divided so as to include a first heat-source-side heat exchanger and a second heat-source-side heat exchanger on a lower side of the first heat-source-side heat exchanger, a first heat-source-side flow rate adjusting valve, an opening degree of which is adjustable, being connected to a liquid side of the first heat-source-side heat exchanger such that the first heat-source-side flow rate adjusting valve is located downstream of the first heat-source-side heat exchanger in a flow of the refrigerant in a case of operating as a radiator of the refrigerant, a second heat-source-side flow rate adjusting valve, an opening degree of which is adjustable, being connected to a liquid side of the second heat-source-side heat exchanger such that the second heat-source-side flow rate adjusting valve is located downstream of the second heat-source-side heat exchanger in the flow of the refrigerant in a case of operating as a radiator of the refrigerant, Cv values of the first heat-source-side flow rate adjusting valve and the second heat-source-side flow rate adjusting valve in a state of the opening degrees of the first heat-source-side flow rate adjusting valve and the second heat-source-side adjusting valve being fully open being determined so that the refrigerant flows readily to the first heat-source-side heat exchanger and the refrigerant does not flow readily to the second heat-source-side heat exchanger, in comparison with a heat transfer area ratio between the first heat-source-side heat exchanger and the second heat-source-side heat exchanger, the defrost operation being performed in order to defrost the first and second heat-source-side heat exchangers by stopping the outdoor fan and causing the first and second heat-source-side heat exchangers to operate as radiators of the refrigerant, and to cause the usage-side heat exchanger to operate as an evaporator of the refrigerant when frost forms on the first and second heat-source-side heat exchangers operating as evaporators of the refrigerant, and the opening degrees of the first and second heat-source-side flow rate adjusting valves being controlled in the defrost operation so as to achieve a defrost flow rate ratio at which more of the refrigerant flows to the second heat-source-side heat exchanger than during an air-cooling operation in which the first and second heat-source-side heat exchangers operate as radiators of the refrigerant and the usage-side heat exchanger operates as an evaporator of the refrigerant.

2. The refrigeration apparatus according to claim 1, wherein the defrost flow rate ratio is achieved by setting the second heat-source-side flow rate adjusting valve to fully open and setting the first heat-source-side flow rate adjusting valve to a second opening degree that is less than a first opening degree during the air-cooling operation.

3. The refrigeration apparatus according to claim 1, wherein the opening degrees of the first and second heat-source-side flow rate adjusting valves are set in the defrost operation to opening degrees that yield the defrost flow rate ratio when the defrost operation is started and until the defrost operation ends, with the opening degrees being kept at the opening degrees that are set when the defrost operation is started.

4. The refrigeration apparatus according to claim 2, wherein the opening degrees of the first and second heat-source-side flow rate adjusting valves are set in the defrost operation to opening degrees that yield the defrost flow rate ratio when the defrost operation is started and until the defrost operation ends, with the opening degrees being kept at the opening degrees that are set when the defrost operation is started.

* * * * *